US006312529B1

(12) United States Patent
Leap et al.

(10) Patent No.: US 6,312,529 B1
(45) Date of Patent: Nov. 6, 2001

(54) STEEL COMPOSITIONS AND METHODS OF PROCESSING FOR PRODUCING COLD-FORMED AND CARBURIZED COMPONENTS WITH FINE-GRAINED MICROSTRUCTURES

(75) Inventors: Michael J. Leap, Massillon; James C. Wingert, North Canton, both of OH (US)

(73) Assignee: The Timken Company, Canton, OH (US)

( * ) Notice: Subject to any disclaimer, the term of this patent is extended or adjusted under 35 U.S.C. 154(b) by 0 days.

(21) Appl. No.: 09/402,688

(22) PCT Filed: May 7, 1998

(86) PCT No.: PCT/US98/09415

§ 371 Date: Oct. 7, 1999

§ 102(e) Date: Oct. 7, 1999

(87) PCT Pub. No.: WO98/50594

PCT Pub. Date: Nov. 12, 1998

Related U.S. Application Data

(60) Provisional application No. 60/045,860, filed on May 8, 1997.

(51) Int. Cl.[7] ..... C22C 38/06; C22C 38/12; C23C 8/22

(52) U.S. Cl. ..... 148/226; 148/233; 148/319; 420/127; 420/128

(58) Field of Search ..... 420/127, 128; 148/226, 319, 233

(56) References Cited

U.S. PATENT DOCUMENTS 4,634,573 1/1987 Yanagiya et al. ..... 420/127
4,802,918 * 2/1989 Ooki et al. ..... 420/8

FOREIGN PATENT DOCUMENTS 0133959 3/1985 (EP) .
0159155 8/1985 (JP) .

OTHER PUBLICATIONS

Ohshiro, Takehiko et al., "Prevention of Austenite Grain", *Fundamentals of Microalloying Forging Steels*, The Metallurgical Society, pp. 315–322 (1987).
Speer, J.G. et al., "Carbonitride Precipitation in Niobium/Vanadium Microalloyed Steels", *Metalurgical Transactions A*, vol. 18A, pp. 211–222 (Feb.1987).
Hillert, M. et al., "The Regular Solution Model for Stoichiometric Phases and Ionic Melts", *Acta Chemica Scandinavica* 24, No. 10, pp. 3618–3626 (1970).

* cited by examiner

*Primary Examiner*—Deborah Yee
(74) *Attorney, Agent, or Firm*—Webb Ziesenheim Logsdon Orkin & Hanson, P.C.

(57) ABSTRACT

Steel compositions and processes are described that provide optimum resistance to austenite grain coarsening in cold-formed and carburized components for automotive and machine structural applications. The steel compositions include, in weight percent, 0.1–0.3% C 150–220 ppm N and a grain refining addition selected from the group consisting of Al, V plus Al and Nb plus Al, the balance comprising iron and other alloying elements typically found in carburizing grades of steel. The steels are processed by reheating to a temperature in the vicinity of solution temperature of the least soluble species of grain refining precipitate and then hot worked. The hot-worked steel is cooled at an accelerated rate to 500° C. and then subcritically annealed, cold formed in at least one operation with intermediate anneals subcritically annealed after the last cold-forming operation, and carburized quenched and tempered (6).

22 Claims, 10 Drawing Sheets

150 ppm N (T = 930C)

220 ppm N (T = 930C)

STEEL COMPOSITIONS AND METHODS OF PROCESSING FOR PRODUCING COLD-FORMED AND CARBURIZED COMPONENTS WITH FINE-GRAINED MICROSTRUCTURES

This application is a 371 of IBT/VS98/09415 filed Jun. 7, 1998.

BACKGROUND OF THE INVENTION

The present invention relates to steel compositions and processes for treating such compositions that provide a fine-grained austenite microstructure after carburization, useful in cold-formed components which are destined for automotive and machine structural applications.

Various types of highly stressed components for automotive drive train and machine structural use are manufactured by cold forming and carburizing. Cold forming is utilized to reduce energy and material consumption costs associated with various manufacturing processes while case carburizing provides a resultant microstructure with a hard, wear-resistant outer case and a tough, ductile inner core. Cold forced automobile parts such as constant velocity, gears and piston pins are some examples of the end uses of such components. However, cold-formed components are particularly susceptible to abnormal grain coarsening during carburization, and the formation of duplexed grain structures is manifested as problems with distortion, low fatigue life and poor toughness in-the final component. There have been prior attempts to circumvent these problems by utilizing steel compositions and processes that maintain a fine-grained austenite microstructure during carburizing; however, many of these steels and processes are of limited utility in components that experience large reductions and the non-uniform accumulation of strain through the component cross-section during cold forging.

A recent attempt to solve the grain coarsening problem in cold-formed and carburized components is addressed in U.S. Pat. No. 4,634,573 to Yanagiya et al. The Yanagiya et al. patent is directed to a high-nitrogen steel containing grain-refining elements of niobium and aluminum as well as a method of processing that is said to maximize cold formability.

The recent work of Ohshiro et al., published in: Fundamentals of Microalloving Forging Steels, The Metallurgical Society Warrendale. Pennsylvania 1987 at pages, 315–322, addresses the problem of grain coarsening in cold-formed 0.17% C steels with nitrogen contents representative of electric-furnace steelmaking practices (70–130 ppm). Billets of the steels were reheated at temperatures in the 970–1150° C. range and hot roiled to 15 mm diameter rods with a finish rolling temperature of 900° C. (±25° C.). Sections of the wire rods were annealed at 740° C. for three hours, machined into test pieces, cold rolled, reheated at temperatures in the 900–975° C. range for three hours, and water quenched. The Ohshiro et al. work indicates that increases in the dissolution of coarse precipitates with increases in reheating temperature provide an increased amount of solute for the precipitation of fine particles during hot rolling and subsequent annealing at 740° C. Ohshiro et al. also provides data which suggest that heterogeneity in the as-transformed austenite grain size is linked to heterogeneity in the recrystaijized ferrite grain size after cold forming, and this non-uniformity in the as-transformed austenite grain structure is related to the degradation in the grain coarsening resistance of the austenite microstructure during carburizing. Although these data provide an adequate explanation for the formation of duplex austenite grain structures after light (10–20%) cold reductions, these investigators did not indicate any method(s) of controlling this phenomenon. Moreover, the compositions utilized by these investigators are, generally speaking, too lean to provide good grain coarsening resistance under more severe conditions (i.e., high cold reductions followed by carburizing for much longer times).

SUMMARY OF THE INVENTION

The present invention provides high-nitrogen steels, on the order of 150–220 ppm N, with different combinations of grain-refining elements which after being subjected to the application of appropriate processes that are intimately integrated with either a single or multiple cold-forming operation, exhibit good austenite grain coarsening resistance during carburization. Within the context of this invention, the compositional factors such as sulfur content and oxygen content are maintained at appropriate levels in order to assure an adequate degree of cold formability.

More particularly, the present invention provides high-nitrogen steels with a grain-refining addition comprising niobium and aluminum in appropriate combinations, vanadium and aluminum in appropriate combinations, or aluminum as the sole grain-refining addition. The invention further provides methods of processing that yield a cold-formable steel with an appropriate precursor microstructure for providing good grain coarsening resistance during carburization.

Briefly stated, a first presently preferred method of processing to optimize the grain coarsening resistance of cold-formed components according to the invention comprises reheating and hot working billets at high temperatures, preferably in the vicinity of the solution temperature of the least soluble species of grain-refining precipitate in the steel, followed by accelerated cooling to about 500° C. The steel is then subcritically annealed in the range of temperature between 650° C. and the $A_{cl}$, subjected to one or more cold-forming operations with intermediate anneals, subcritically annealed after the last cold-forming operation, and carburized. A second presently preferred method of processing according to the invention, which is applicable to high-nitrogen steels containing combinations of niobium and aluminum, comprises the steps of reheating at high temperatures, preferably at temperatures above the solution temperature of the least soluble species of grain-refining precipitate in the steel, cooling and subsequent hot rolling at temperatures in the 900°–1100° C. range, followed by accelerated cooling to about 500° C. The steel is then subcritically annealed in the range of temperature between 650° C. and the $A_{cl}$, subjected to one or more cold-forming operations with intermediate anneals, subcritically annealed after the last cold-forming operation, and carburized.

DETAILED DESCRIPTION OF THE INVENTION

Processing

Processing can be considered in terms of a series of operations that ultimately provide good grain coarsening resistance in cold-formed components during carburization. The first step in the overall process is the final hot-working operation for the steel, accomplished by either rolling or forging. Within the context of maintaining a fine-grained microstructure during carburization, reheating must be conducted at a temperature near or above the solution temperature of the least soluble species of grain-reining precipitate in a steel, and finish working should be conducted at as high a temperature as possible. The objective of this processing operation is to dissolve the largest possible quantity of precipitate in the steel and then limit the extent of both general and strain-induced precipitation in austenite. After hot working, the steel is cooled at an accelerated rate to about 500° C. in order to inhibit, or at least limit the amount of reprecipitation of the grain-refining elements in austenite. This type of processing is applicable to high-nitrogen steels containing niobium and aluminum, vanadium and aluminum, and aluminum as the sole grain-refining addition.

Figure 1:
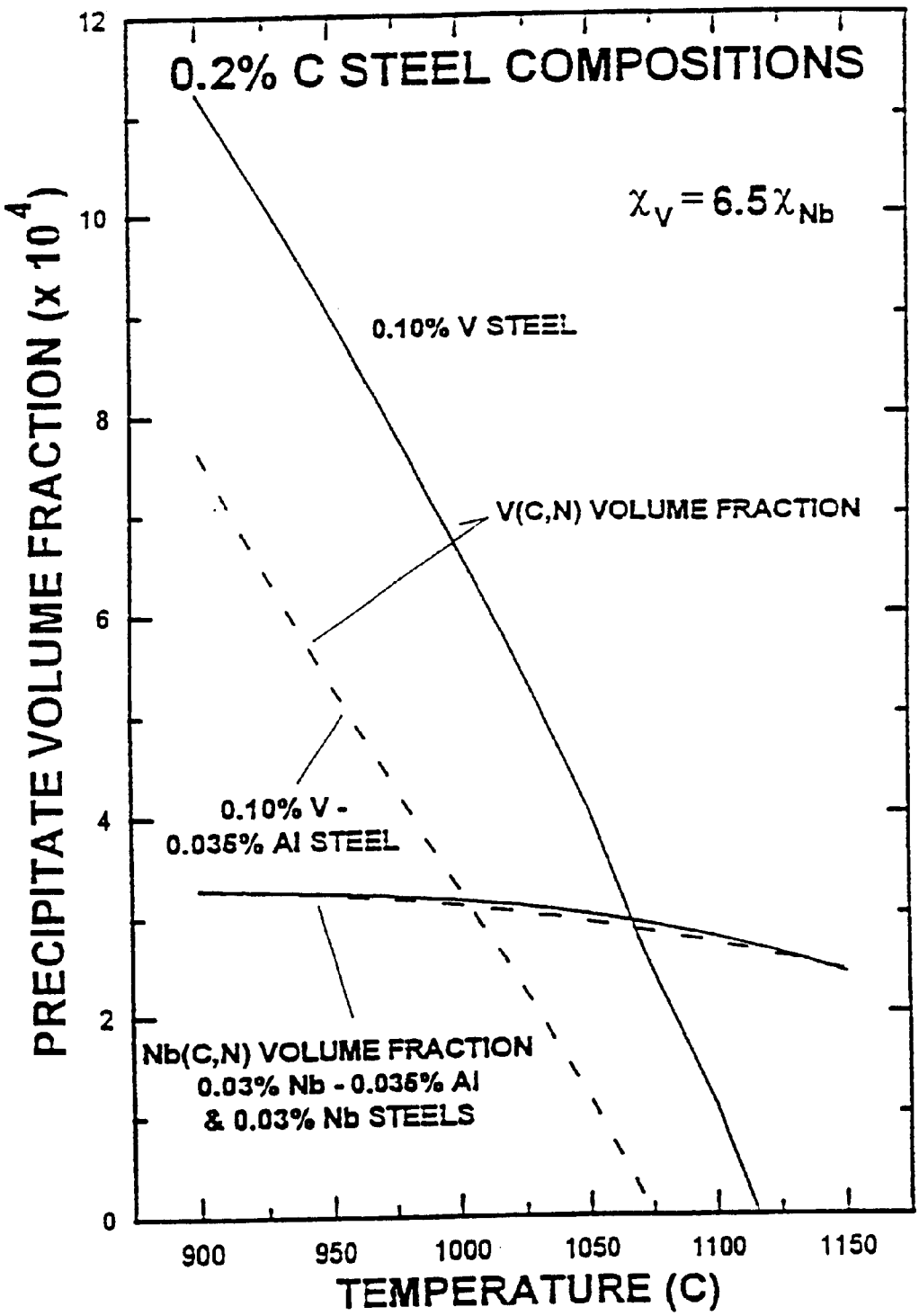
FIG. 1 is a graph showing the equilibrium volume fractions of V(C,N) and Nb(C,N) as a function of temperature for 0.2% C–200 ppm N steel compositions with 0% Al to and 0.035% Al, wherein the atomic percentage of vanadium is roughly 6.5 times that of niobium.

An alternative method of processing can be utilized for high-nitrogen steels containing niobium and aluminum, wherein the steel is reheated at high temperatures to resolve grain-refining precipitates, cooled and then hot worked at temperatures below 1100° C. This type of processing, which is possible as a result of the high thermodynamic stability of Nb(C,N), effectively promotes the precipitation of Nb(C,N) at relatively high temperatures. An example of the differences in predicted carbonitride content of several relevant steel compositions is shown in FIG. 1. These data suggest that if the content of carbonitrides in the Nb—Al and V—Al steels approaches the equilibrium values to the same extent during hot rolling, a substantial content of thermodynamically stable Nb(C,N) can be precipitated at temperatures between 1100° C. and 900° C. (i.e., a temperature in the general vicinity of the recrystallization stop temperature), irrespective of the aluminum content of the steel. In contrast, the inability to precipitate the maximum amount of V(C,N) in this temperature range is compounded by the fact that the V(C,N) volume fraction is highly dependent on the content of aluminum in a steel since V(C,N) and AlN exhibit similar thermodynamic stabilities in austenite. Thus, the ability to effectively utilize recrystallization rolling as a means of providing large volume fractions of fine, thermodynamically stable carbonitride precipitates is unique to high-nitrogen steels containing niobium in combination with aluminum. For Nb—Al steels processed in this manner, accelerated cooling after finish working should also be conducted to limit any potential coarsening of Nb(C,N) and AlN present in the recrystallized austenite microstructure.

After hot rolling and accelerated cooling, the next step in either process comprises subcritical annealing at temperatures between 650° C. and the $A_{cl}$. This heat treatment is conducted for a variety of reasons. First, subcritical annealing for a sufficient amount of time in this temperature range promotes the precipitation of the maximum amount of grain-refining elements in ferrite, and in combination with either of the aforementioned hot-working procedures this type of processing results in the development of a dense dispersion of fine carbonitride and AlN precipitates. Second, subcritical annealing produces an appropriate precursor microstructure for maximizing the grain coarsening resistance of the material after cold forming; that is, the formation of a ferritic microstructure with well dispersed iron/alloy carbides is ideal from the standpoint of developing an as-transformed austenite microstructure with a uniform grain size. Since the iron/alloy carbides provide sites for the nucleation of austenite and well-dispersed sources of carbon to promote austenite growth during reheating through the intercritical regime, the uniformity of the as-transformed austenite grain structure is not as dependent on the uniformity of the recrystallized ferrite grain size, such that improvements in grain coarsening resistance can be realized in components subjected to non-uniform deformation during cold forming. Finally, subcritical annealing improves the formability of the material and minimizes both cold-forming loads and the degradation in die life.

The hot-worked and subcritically annealed material is subjected to a cold-working operation or a series of cold-working operations with intermediate subcritical anneals. After each cold-working operation, steels of both the present invention and prior art are subjected to a recrystallization anneal, where reheating is conducted at temperatures between 600° C. and the $A_{cl}$ for a sufficient amount of time to fully soften the ferritic microstructure for the next cold-forming operation. However, a preferred embodiment of the present invention includes the application of a subcritical anneal after the last cold-forming operation. The objective of this final annealing treatment is to minimize microstructural heterogeneities introduced during the last cold-forming operation, such that heterogeneity in the as-transformed austenite microstructure is minimized during subsequent carburization. This latter embodiment of the present invention is a clear improvement over the prior art, where no attempts are made to control the uniformity and size of the as-transformed austenite microstructure through the development of an appropriate precursor microstructure.

Two general types of annealing treatments can be utilized within the framework of the present invention. Cold-formed steels can be annealed at temperatures between approximately 600° C. and the $A_{cl}$ for a sufficient amount of time to establish a recrystallized ferrite microstructure containing well dispersed iron/alloy carbides. A recovery anneal can also be utilized after the last cold-forming operation to reduce non-uniformities in the microstructure, thereby reducing heterogeneity and improving the grain coarsening resistance of the as-transformed austenite microstructure during subsequent carburization. A two-stage annealing treatment could also be applied after the last cold-forming operation with the objective of progressively eliminating non-uniform accumulations of strain in the microstructure via recovery processes. The first anneal would be utilized to decrease the internal strain energy to such a degree that additional recovery at higher temperatures would be possible without interference from recrystallization.

Steel Compositions

One general technique of preventing grain coarsening under conditions of extended time at temperature (e.g., carburization) is to increase the content of thermodynamically stable, grain-refining precipitates through additions of nitrogen to a steel. In this connection, experience has shown that the resistance to grain coarsening in cold-formed components is relatively poor when the nitrogen content is less than 150 ppm. At the opposite extreme, other investigators have specified a maximum nitrogen content of 300 ppm based on soundness limitations in the wrought product, and this maximum concentration was specified without much regard to the reduction in grain coarsening resistance resulting from the retention of large nitrogen-rich particles through the reheating and hot-working operations. The upper bound on nitrogen content is limited to about 220 ppm in the present invention. This value represents a compromise between maintaining the ability to fully dissolve all grain-refining precipitates at 1300° C. (i.e., realistic maximum reheating and hot-working temperature for steels with 0.1–0.3% C) and maximizing the content of fine grain-refining precipitates in the microstructure prior to carburization. By way of example, a steel containing 300 ppm N would have a higher volume fraction of precipitates than a steel containing 200 ppm N, but a significant portion of the dispersion in the former would be comprised of large particles that are ineffective at pinning grain boundaries during carburizing. These large particles also degrade the mechanical properties of the resultant, tempered martensitic microstructure.

In addition to a high nitrogen content, which provides a large content of grain-refining precipitates, the stability of AlN and microalloy carbonitrides is dependent on the content(s) of metalloid element(s) in a steel. For the case of high-nitrogen steels containing aluminum as the sole grain-refining element, the maximum amount of AlN at any temperature is obtained when the aluminum content is stoichiometrically balanced with the nitrogen content (i.e. $[Al]_{EFF}/[N]=1.92$, where $[Al]_{EFF}=[Al]_{TOTAL}-1.20[O]$). Although this defines the most thermodynamically stable composition, it is preferable to alloy steels with a slightly hyperstoichiometric ratio of aluminum to nitrogen ($[Al]_{EFF}/[N]<1.92$) in order to minimize the potential for precipitate ripening during carburization. Since aluminum is typically added to steel within a ±0.003% range, compositional limits on aluminum can be defined in terms of the specified range of nitrogen content and the aforementioned inequality. This yields bounding values of about 0.026% to 0.039% for the aluminum content in the high-nitrogen steels of the present invention.

Figure 2B:
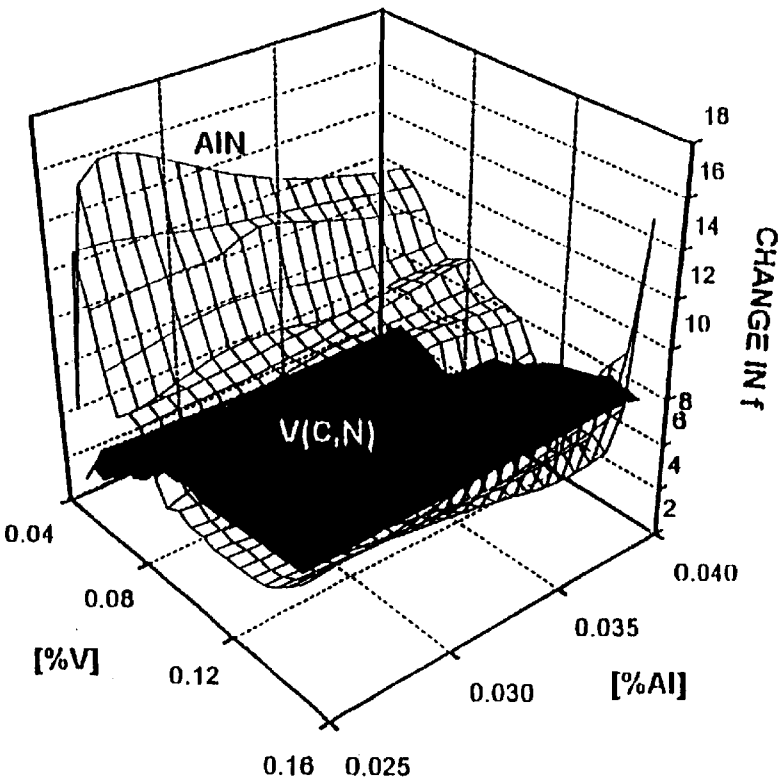
FIG. 2*b* depicts the change in equilibrium V(C,N) and AlN volume fractions associated with an increase in temperature from 700° C. (ferrite matrix) to 930° C. (austenite matrix) as a function of vanadium and aluminum contents for steel compositions with 150 ppm N.
Figure 2A:
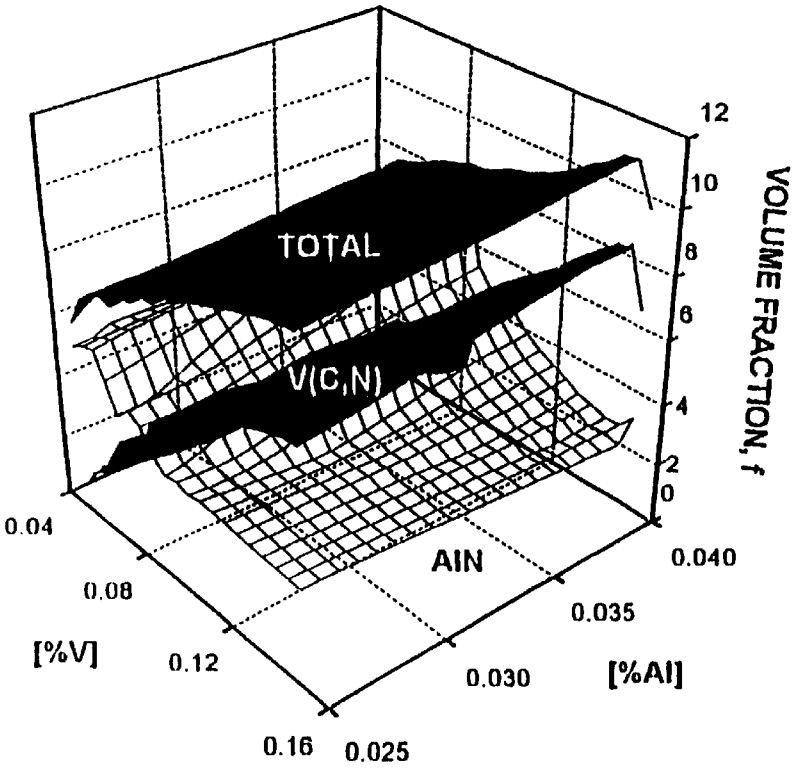
FIG. 2*a* is a graph showing the equilibrium volume fractions of V(C,N), AlN and V(C,N)+AlN at 930° C. as a function of vanadium and aluminum contents for steel compositions with 150 ppm N.
Figure 3B:
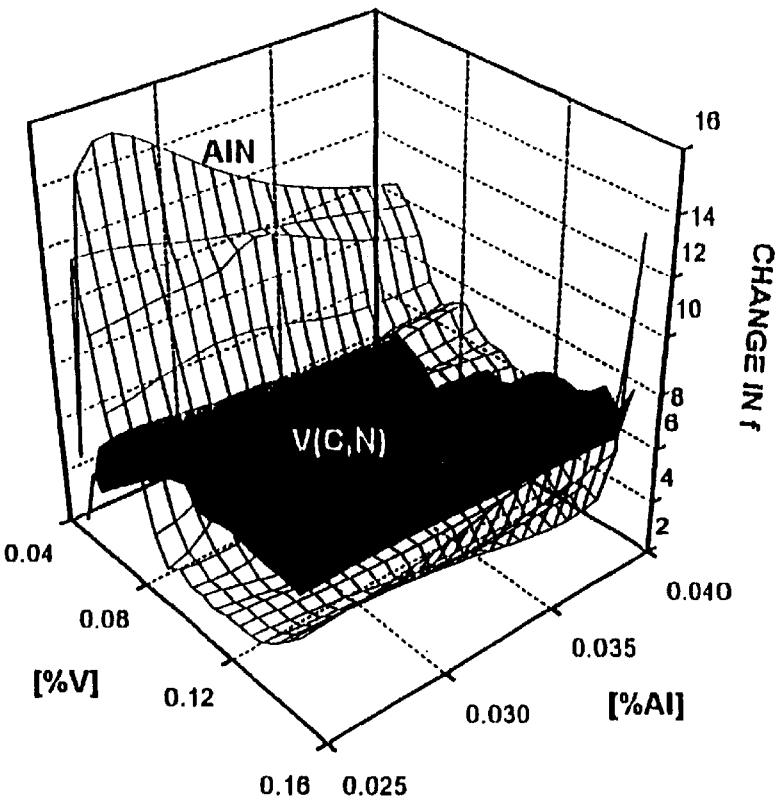
FIGS. 3*a* and 3*b* are the same as FIGS. 2*a* and 2*b* but use steel compositions having 220 ppm N.
Figure 3A:
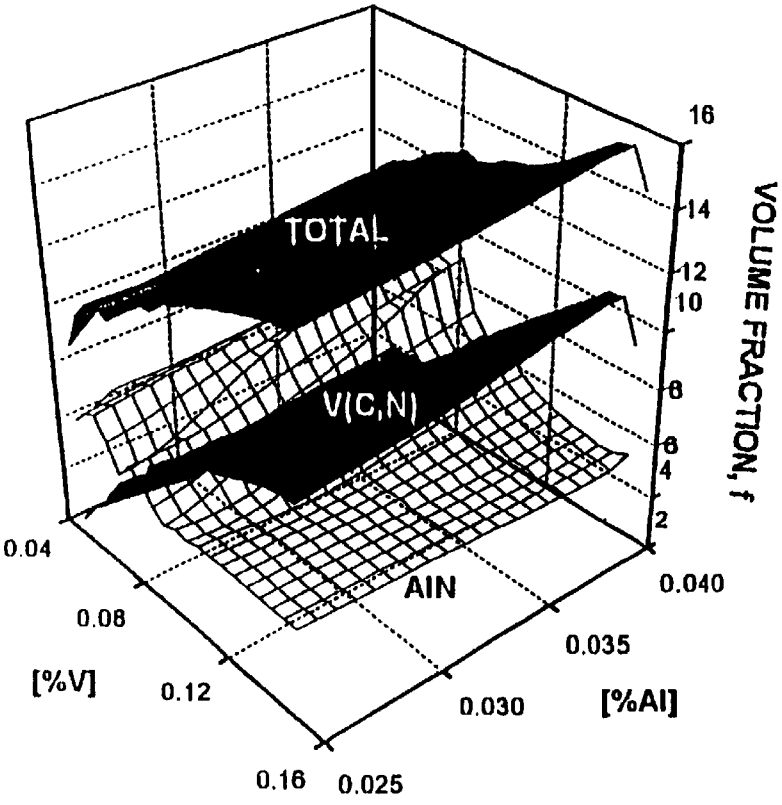

Compositional limits can also be specified over the 150–220 ppm range of nitrogen content for 0.1–0.3% C steels containing grain-reining additions of vanadium and aluminum; however, the founding of compositional limits for this class of steels is more difficult since VN and AlN exhibit similar solubilities in austenite. The equilibrium precipitate volume, fractions at 930° C. (which represents a standard carburizing temperature for many applications) and the changes in the precipitate volume fractions associated with an increase in temperature from 700° C. (ferrite matrix) to 930° C. (austenite matrix) are shown as functions of aluminum and vanadium contents in FIGS. 2 and 3 for nitrogen contents of 150 ppm and 220 ppm, respectively. The AlN volume fraction exhibits a local maximum over the 0.05–0.06% range of vanadium content, and the magnitude of this local maximum increases with aluminum content. Decreases in AlN volume fraction with increases in vanadium content above approximately 0.06% occur in conjunction with a monotonically increasing V(C,N) volume fraction, such that increases in the vanadium and aluminum contents produce a gradual increase in the total volume fraction of grain-refining precipitates at both nitrogen levels.

For the present case in which two species of grain-refining precipitates with similar thermodynamic stabilities coexist after subcritical annealing, the most effective means of maintaining a stable grain size during subsequent carburization is to minimize the extent of precipitate dissolution that can occur during the $\alpha \rightarrow \gamma$ transformation. The change in V(C,N) volume fraction associated with an increase in temperature from 700° C. to 930° C. is relatively insensitive to steel composition at vanadium contents above approximately 0.05%, but the change in equilibrium AlN content exhibits a local maximum that is coincident with the local maximum in AlN volume fraction at 930° C. However, the change in AlN volume fraction decreases to low levels with increases in vanadium content above about 0.08%, such that transformation-induced decreases in both the V(C,N) and AlN volume fractions are minimized to the greatest extent physically possible at vanadium contents up to about 0.15%. Since the solution temperature for AlN is substantially higher than that for V(C,N) in high-nitrogen steels, the allowable range of aluminum content for V—Al steels is equivalent to the compositional range specified for aluminum-killed, high-nitrogen steels (i.e., 0.026–0.039% Al based on a maximum solution treatment temperature of 1300° C.). Thus, V—Al steels with optimized austenite grain coarsening resistance include compositions consisting essentially of 0.1–0.3% C, 0.08–0.15% V, 0.026–0.039% Al and 150–220 ppm N.

Figure 4:
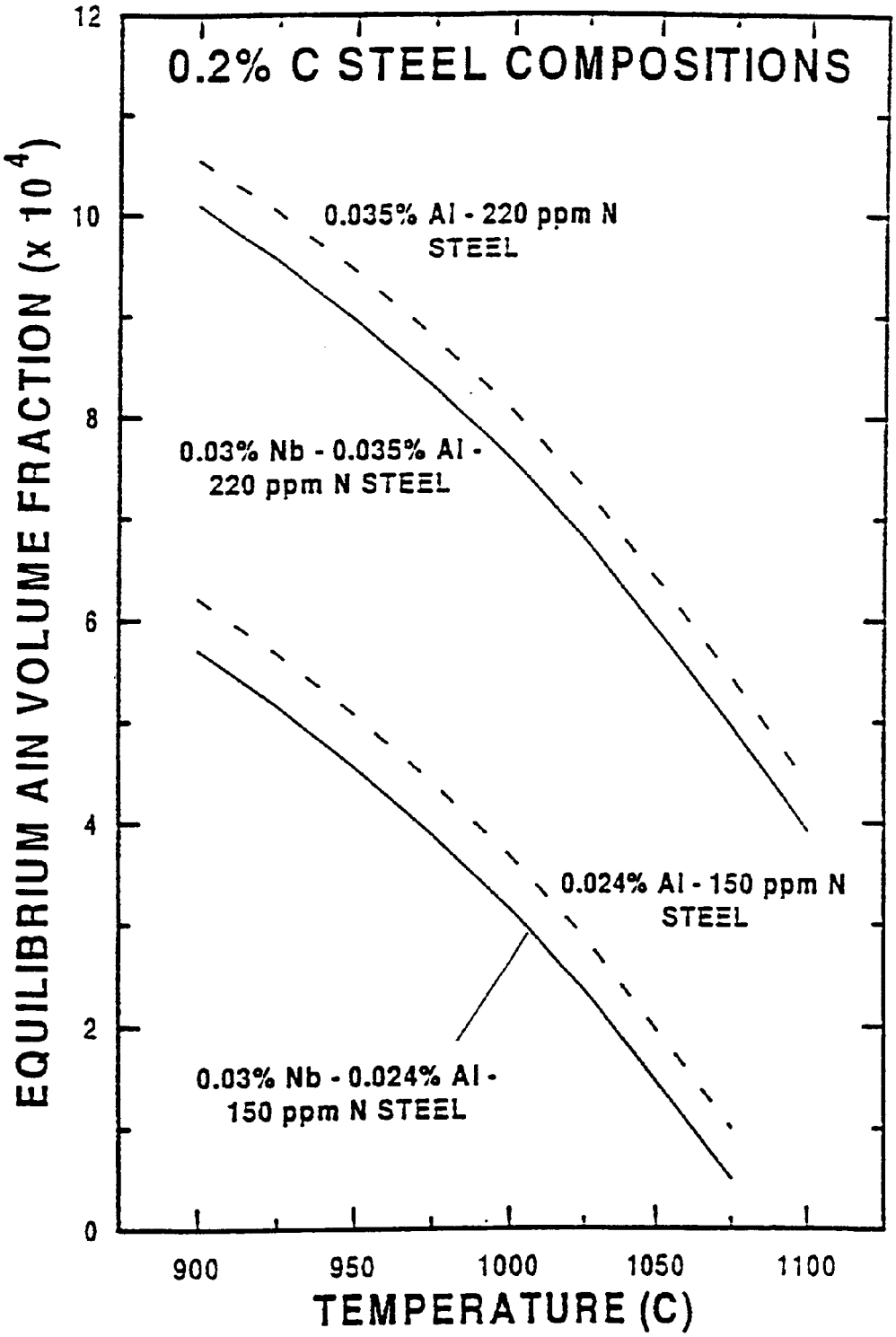
FIG. 4 is a graph showing the equilibrium AlN volume fraction as a function of temperature for 0.2% C steel compositions containing various contents of niobium, aluminum and nitrogen.
Figure 5:
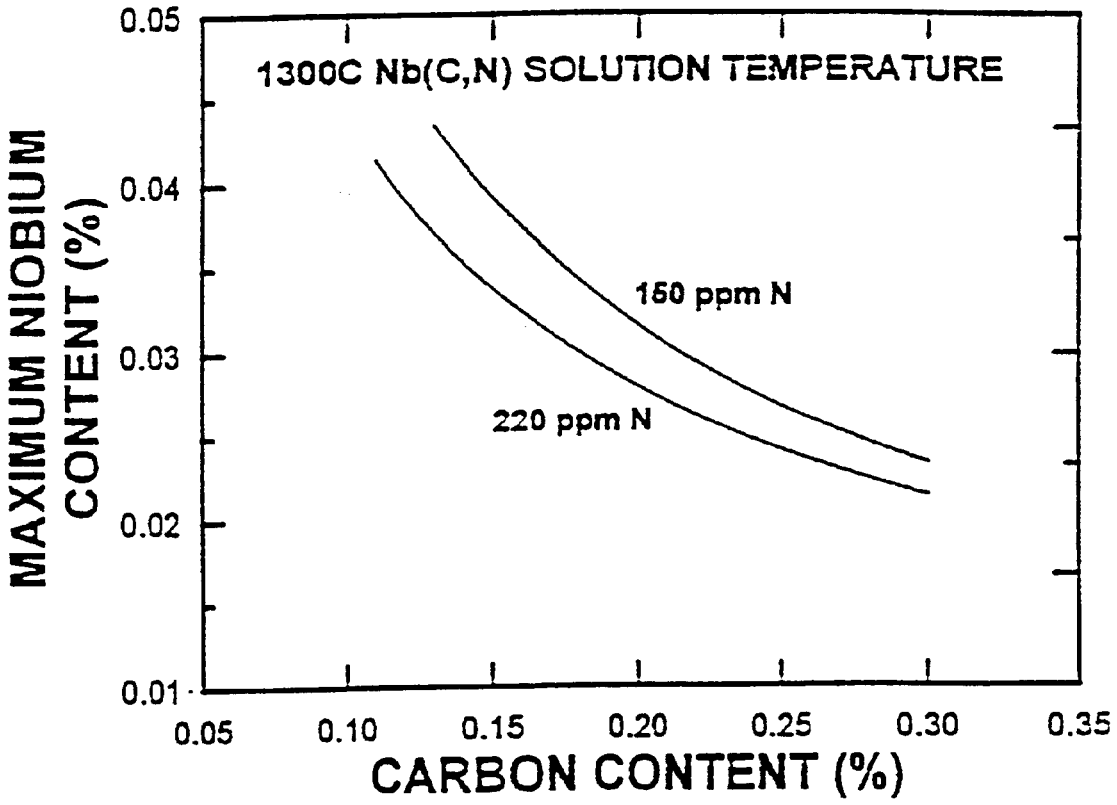
FIG. 5 is a graph of the maximum soluble niobium content as a function of carbon and nitrogen contents for a Nb(C,N) solution temperature of 1300° C.

Based on a maximum solution treatment temperature of 1300° C., compositional limits can be specified for steels containing a grain refining addition of niobium and aluminum. In defining compositional limits, it is necessary to recognize that high-nitrogen steels containing niobium and aluminum are somewhat unique in that (i) the equilibrium content of Nb(C,N) is relatively constant over a broad range of austenitizing temperature, FIG. 1, and; (ii) the formation of Nb(C,N) only has a small, relatively constant effect on the equilibrium AlN content over the same range of temperature, FIG. 4. These unique properties allow the direct calculation of aluminum contents that provide hyperstoichiometric [Al]/[N] ratios once appropriate ranges of niobium content and Nb(C,N) composition have been determined as a function of carbon content Towards this end, the limiting niobium contents associated with a Nb(C,N) solution temperature of 1300° C. are shown as a function of carbon content in FIG. 5 for steel compositions containing 150 ppm N and 220 ppm N. For carbon contents between 0.1% and 0.3%, a range encompassing the concentrations typically associated with carburizing grades of steel, the maximum allowable niobium content varies from 0.02% to 0.04%. Based on the calculated ranges of Nb(C,N) composition over the 900–1000° C. range of carburizing temperature and the specified ranges of nitrogen (150–220 ppm) and niobium (0.02–0.04%) contents, the limiting aluminum content can be obtained from the relationship:

$$[\%Al] \leq 1.9[\%N] - 0.045[\%Nb][\%C]^{-0.56} + 1.12[\%O],$$

where the elemental concentrations are specified in weight percentages. Although the above equation expresses the relationship for maximum aluminum content in terms of an inequality, it is advantageous to maintain the aluminum content at as high a level as possible from the standpoint of austenite grain coarsening resistance.

After the application of the aforementioned processes, steel compositions of the present invention can be carburized over a broad range of time and temperature without the formation of harmful duplexed grain structures. Unlike the prior art, the processes and steel compositions of the present invention are particularly useful under the types of conditions found in most industrial applications; that is, component geometries subjected to non-uniform deformation during cold forming.

EXAMPLES

Embodiments of the present invention will be illustrated through examples for each general type of high-nitrogen steel (i.e., steels containing aluminum, vanadium in combination with aluminum, and niobium in combination with aluminum as the grain-refining elements). These steels contain other conventional alloying elements, such as manganese, silicon, chromium, nickel and molybdenum, typically found in carburizing grades of steel.

The compositions of the steels are listed in Table 1. The steels of the present invention containing grain refining additions of Al, Nb—Al and V—Al are designated steels A2 to A4, N1 to N3 and V1 to V6, respectively. Steels A1, A4, N2 and N3 were obtained in the form of hot-rolled bars from fill-size, production-type heats, whereas the remaining steels were melted as 45 kg vacuum induction melted (VIM) ingots. The VIM ingots were reheated at temperatures in the 123°–1260° C. range for 3–4 hours, upset forged (50% reduction), cross-forged to cross-sectional dimensions of 70 mm×140 mm, and air cooled to room temperature. The forged ingots were subsequently milled to cross-sectional dimensions of 60 mm×130 mm and sectioned to provide billets for hot rolling.

The steels were processed using two different hot-rolling schedules in the following examples. The steels were subjected to a high-temperature processing schedule in which billet and bar sections were reheated at temperatures in the vicinity of the solution temperature of the least soluble species of rain-refining precipitate in each steel (i.e., temperatures between 1250° C. and 1300° C.), hot rolled to 19 mm plate in five passes, and air cooled to room temperature. The steels were also subjected to a low-temperature schedule in which billet sections were reheated at temperatures in the vicinity of the solution temperature of the least soluble species of grain-refining precipitate in the steel, cooled to 1100° C. and equilibrated for one hour, hot rolled to 19 mm plate in five passes, and air cooled to room temperature. Compression specimens (25 mm×13 mm ϕ) were extracted from the mid-plane of the hot-rolled plates in the longitudinal orientation.

Figure 6:
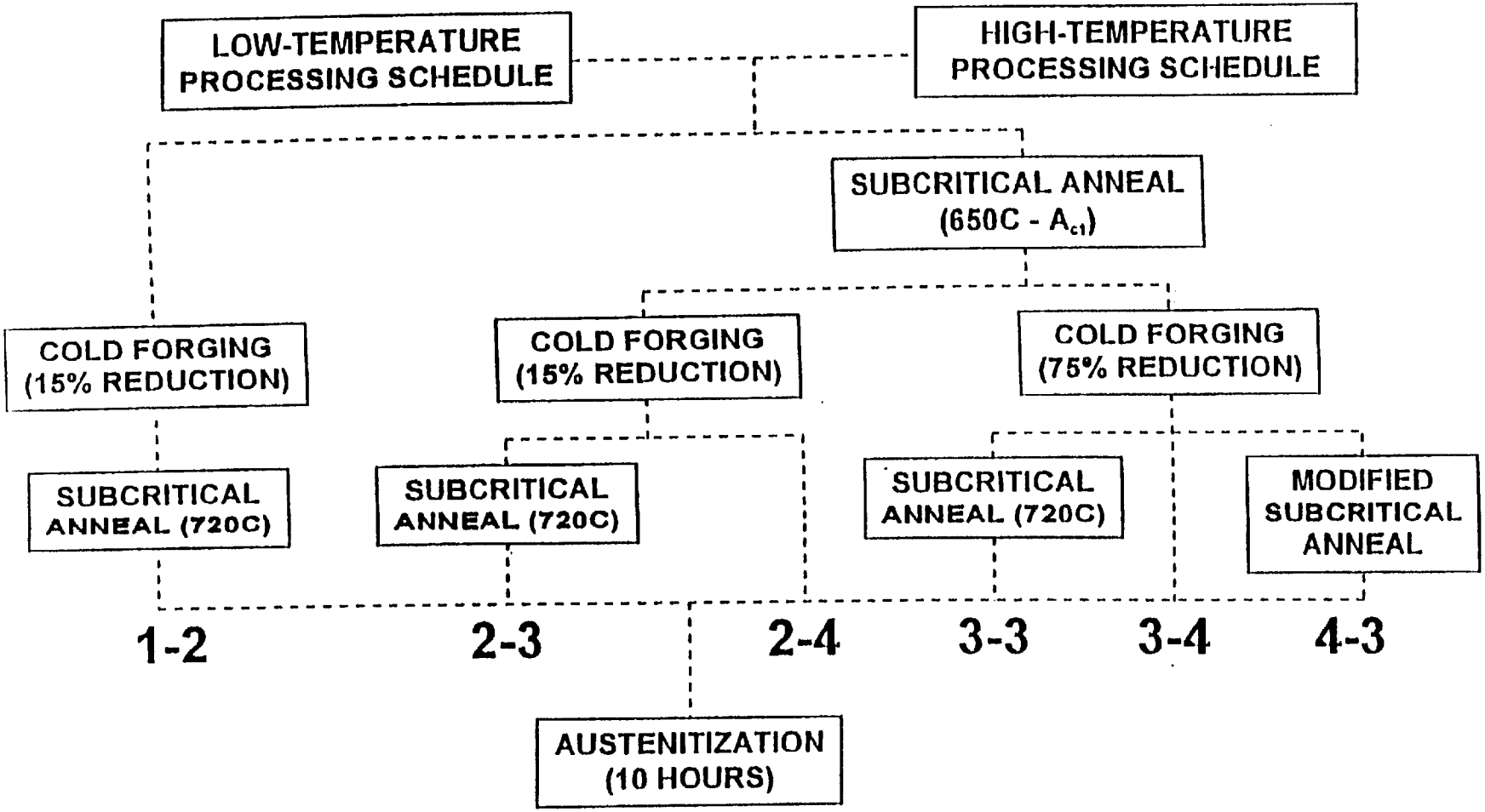
FIG. 6 is a flow chart showing the various cold-forming and subcritical annealing processing schedules evaluated herein.

Compression specimens were subjected to several different cold-forming and annealing schedules to simulate various methods of processing, FIG. 6. The first three variants of the schedule are based on the poor grain coarsening resistance observed by Ohshiro et al. after the application of light (10–20%) cold reductions. The first variant of the process. designated processing code 1–2, consists of cold forging (15% reduction) the hot-rolled material, subcritical annealing at 720° C. for three hours, and austenitization at 954° C. for ten hours. Two other low-reduction variants of the process comprise subcritical arnnealing at 720° C. for three hours, cold forging (15% reduction), and either subcritical annealing at 720° C. for three hours followed by austenitization for ten hours (processing code 2-3) or austenitization for ten hours directly after cold forging (processing code 2-4). Compression specimens were also subcritically annealed at 720° C. for three hours, cold forged (75% reduction), and either subcritically annealed at 720° C. for three hours followed by austenirization for ten hours (processing code 3-3) or austenitized for ten hours directly after cold forging (processing code 3-4). A majority of the grain-coarsening study was conducted on specimens austenitized at 954° C. for ten hours, although the grain-coarsening resistance of steels A3, A4, N2 and N3 was also evaluated for a ten hour austenitization time at temperatures in the 899–1010° C. range.

In addition to processing code 3-3, which incorporates a recrystallization anneal at 720° C. between the cold-forging and austenitization operations, several different annealing treatments were applied to selected cold-formed steels prior to austenitization; this processing schedule is designated processing code 4-3 in FIG. 6. The annealing treatments include a single-stage recovery anneal in the 500–550° C. range for three hours and a two-stage recovery anneal consisting of reheating in the 500–550° C. range for one and one-half hours followed by reheating at 720° C. for one and one-half hours.

Figure 7:
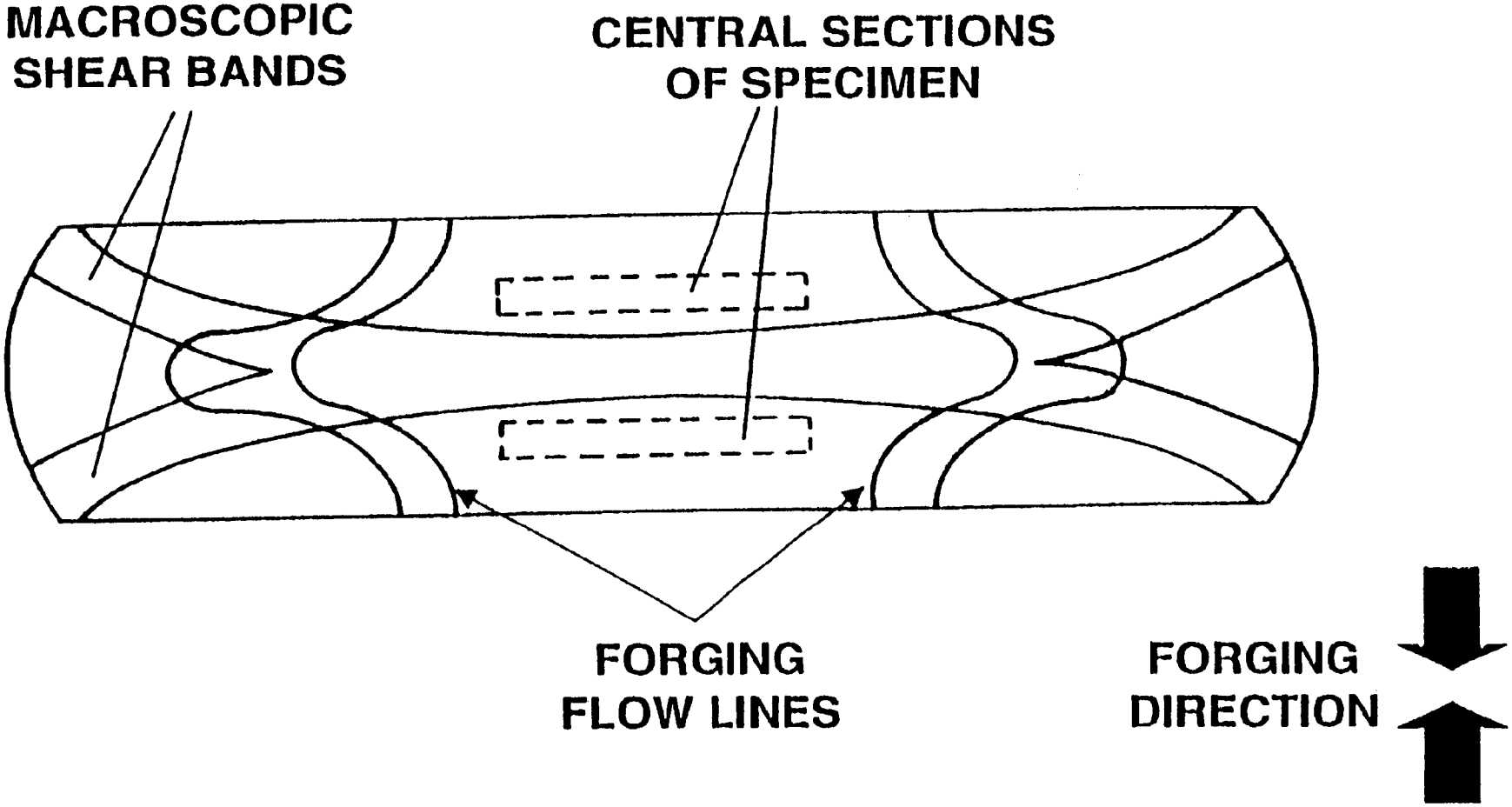
FIG. 7 is an illustration of various regions in a cold-formed compression specimen.

After processing, compression specimens were sectioned along the centerline, prepared for metallographic examination, and etched in a saturated picric acid solution containing sodium tridecylbenzene sulfonate as a wetting agent, Metallographic ratings of prior austenite grain size were obtained in both the central and shear band regions of the compression specimens, FIG. 7.

PROCESSES INCORPORATING RECRYSTALLIZATION ANNEALS

Steels Containing Aluminum

The effects of austenitization at 954° C. for ten hours on the grain strictures of steels A1–A3 are summarized in Tables 2–7. The combination of a low nitrogen content and high [Al]/[N] ratio in the conventional steel (Al) is associated with poor grain coarsening resistance after the application of the low-temperature processing schedule, irrespective of the amount of cold reduction. This steel exhibits improved grain coarsening resistance after high-temperature processing and the application of a 15% cold reduction, but the material exhibits poor 2rain coarsening resistance after a 75% cold reduction, Table 3.

The high-nitrogen steels (A2-A3) exhibit uniformly fine-grained microstructures after either low-temperature or high-temperature processing and the application of a 15% cold reduction, however, these steels exhibit extremely poor grain coarsening resistance after low-temperature processing and a 75% cold reduction, Tables 4 and 6. High-temperature processing promotes the development of uniformly duplexed grain structures after cold forming and austenitization at 954° C. for ten hours (processing code 3-4), but the incorporation of a subcritical anneal prior to austenitization (processing code 3-3) produces microstructures which are fine grained in the regions of the specimens subjected to relatively uniform amounts of strain, Tables 5 and 7.

The similar grain coarsening behavior of steels A2 and A3 is related to the opposing effects of [Al]/[N] ratio and precipitate content at 954° C. The grain coarsening resistance of steel A2 results from a hyperstoichiometric [Al]/[N] ratio (i.e., [Al]<1.92[N]) in combination with a comparatively low equilibrium volume fraction of AlN, whereas the resistance to grain coarsening in steel A3 is derived from the combination of a hyperstoichiometric [Al]/[N] ratio and a higher AlN content. Tnus, the lower precipitate coarsening potential effectively compensates for a lower AlN volume fraction in steel A2, such that the two steels exhibit similar levels of grain coarsening resistance after high-temperature processing.

The compositional dependence of grain coarsening resistance is further illustrated by the results of a grain coarsening study on steel A4, Tables 8 and 9. This steel represents a material with the combination of a hyperstoichiometric [Al]/[N] ratio ($[Al]_{EFF}$/[N]=1.74) and a relatively high content of precipitates (0.031% Al and 174 ppm N). Billets of this material were reheated at about 1260° C., hot rolled to 52 mm bar, and air cooled to room temperature (i.e., a high-temperature processing schedule was applied to the steel). Specimens subjected to a 15% cold reduction, Table 8, exhibit good grain coarsening resistance after austenitization at temperatures up to 968° C. (maximum temperature evaluated for this steel) for the ten hour reheating time, regardless of the specific annealing schedule applied to the steel. After the application of a 75% cold reduction, subcritically annealed and austenitized specimens (processing code 3-3) exhibit a grain coarsening temperature in the 941–954° C. range, whereas specimens austenitized directly after cold forging exhibit abnormal grain coarsening after ten hours at 899° C., Table 9. In both cases, the specimens possess fine-grained microstructures in regions subjected to relatively uniform levels of strain, and grain coarsening is manifested as the formation of a low density of extremely large grains in the macroscopic shear band regions of the specimens (i.e., regions of highly non-uniform strain). A further increase in austenitization temperature produces a transition from the localized growth of a low density of grains in the shear band regions to the growth of a much higher density of rains throughout the specimen volume (the development of uniformly duplexed grain structures) in both material conditions. Nevertheless, the relative ranking of the different process paths remains unchanged from the standpoint of grain coarsening resistance.

The grain coarsening resistance of high-nitrogen steels containing aluminum as the sole grain-refining element is dependent on both steel chemistry (i.e., aluminum content, nitrogen content, and [A]/[N] ratio) and method of processing. It has been demonstrated that cold-formed steels with effective aluminum contents above 0.025% and hyperstoichiometric [Al]/[N] ratios exhibit good grain coarsening resistance after high-temperature processing and the application of pre-forging and post-forging subcritical anneals. Since the grain coarsening resistance of cold-formed steels is limited by the preferential growth of a low density of grains in regions of highly non-uniform strain rather than the formation of a uniformly duplexed grain structure throughout the specimen volume, it may also be possible to maintain good grain coarsening resistance in cold-formed steels by modifying the final annealing treatment prior to carburization. Modifications to the last annealing cycle, which constitute further embodiments of the present invention, will be discussed in a subsequent section.

Steels Containing Vanadium and Aluminum

The effects of austenitization at 954° C. for ten hours on the grain structures of steels V1–V6 are summarized in Tables 10–21. The low-temperature processing schedule is associated with the development of extremely poor grain coarsening resistance in the V—Al steels after cold reductions of either 15% or 75%, irrespective of whether the specimens are austenitized directly after cold forging or subcritically annealed prior to austenitization. Conversely, the steels all exhibit fine-grained austenite microstructures after high-temperature processing, subcritical annealing, cold forging (15% reduction), and austenitization or subcritical annealing and austenitization.

In contrast to the other processing conditions, the grain coarsening resistance of specimens subjected to the high-temperature processing schedule and a 75% cold reduction is somewhat more complicated to understand since data were only generated at 954° C. for a majority of the steels. The high-nitrogen steels containing roughly 0.1% V (steels V1 and V2 exhibit fine-trained microstructures when cold forging is followed by subcritical annealing (processing code 3-3), but the occurrence of coarse grains in the shear band regions of specimens from steel V2. Table 13, indicate that austenitization at 954° C. for ten hours slightly exceeds the critical conditions for abnormal grain growth when cold forging is directly followed by austenitization (processing code 3-4). The steels containing intermediate levels of vanadium and nitrogen (steels V3 and V4) or high levels of both vanadium and nitrogen (steels V5 and V6) exhibit abnormal grain coarsening throughout the compression specimens when cold forging is directly followed by austenitization (processing code 3-4).

When cold forging is followed by subcritical annealing (processing code 3-3) in steels V3–V6, grain coarsening during subsequent austenitization at 954° C. only occurs in the shear band regions of the compression specimens, Tables 15, 17, 19 and 21. This situation is completely analogous to the grain coarsening response of steels A2–A4 in that the resistance to grain coarsening is limited by the growth of a low density of grains in regions of non-uniform strain, and these coarsened regions coexist with the fine-grained microstructure present in regions of relatively uniform deformation. However, increases in austenitization temperature beyond the grain coarsening temperature promote the development of duplex grain structures throughout the specimen volume. Thus, the difference in grain structure after austenitization at 954° C. (i.e., uniformly duplexed in contrast to fine grained with severe coarsening in the shear band regions) effectively represents a processing-induced difference in the grain coarsening temperature of steels V3–V6; that is, the grain coarsening temperature of the cold-formed and austenitized specimens (processing code 3-4) is significantly less than the grain coarsening temperature of the cold-formed specimens which are subcritically annealed prior to austenitization (processing code 3-3).

A grain coarsening study was conducted on steels V1, V3 and V6 to further clarify the microstructural responses resulting from the application of the different processing schedules. The application of the low-temperature processing schedule is associated with the development of poor grain coarsening resistance in all three steels after a 75% cold reduction and austenitization at 899° C. for ten hours. Tables 22, 24 and 26. Grain coarsening is manifested as the formation of uniformly duplexed grain structures over the 899–968° C. range in specimens austenitized directly after cold forging (processing code 3-4). However, abnormal grain growth in the cold-forged and subcritically annealed steels (processing code 3-3) is limited to the shear band regions of the compression specimens austenitized at temperatures up to 941° C. Further increases in austenitization temperature produce a transition to the formation of uniformly duplexed grain structures throughout the specimen volume in the cold-forged and subcritically annealed steels.

The application of the high-temperature processing schedule substantially improves the grain coarsening resistance of steels V1 and V3 when the cold-forged specimens are subcritically annealed prior to austenitization (processing code 3-3), Tables 23 and 25. Conversely, the cold-forced and austenitized specimens (processing code 3-4) exhibit minor amounts of abnormal grain growth at temperatures as low as 913° C. After the application of either annealing schedule, steel V6 exhibits occurrences of larger grains along the forging flow lines in compression specimens austenitized at 899° C., Table 27. Grain coarsening in chemically segregated regions of these specimens makes it difficult to rank tile relative resistance to grain coarsening for the two annealing schedules. For example, cold-foged and subcritically annealed specimens of steel V6 exhibit uniformly fine-grained microstructures after austenitization at 927° C. and minor amounts of abnormal grain growth in the shear band regions after austenitization at 913° C., whereas the cold-forced and austenitized specimens exhibit abnormal grain growth after austenitization at temperatures above 913° C.

Although the high-temperature processing schedule and the application of a subcritical anneal prior to austenitization (processing code 3-3) have been shown to optimize the grain coarsening resistance of high-nitrogen steels containing grain-refining additions of vanadium and aluminum, the data for steels V1, V3 and V6 also illustrate the dependence of grain coarsening resistance on steel composition. Steel V1, which contains grain-refining elements within the specified ranges of the present invention, exhibits the highest grain coarsening temperature (954–968° C.) of all three steels. Steel V3, on the other hand, possesses an effective aluminum content (0.024%) somewhat below the specified minimum (0.026%), and as a result this steel exhibits a lower grain coarsening temperature (927–941° C.). Steel V6, which possesses the lowest effective concentration of aluminum (0.022%), exhibits minor amounts of abnormal grain growth in forging flow lines after austenitization at temperatures as low as 899° C.

Steels Containing Niobium and Aluminum

The effects of processing on the grain coarsening resistance of steels N1 and N2 after austenitization at 954° C. for ten hours are summarized in Tables 28–31. Specimens of both steels exhibit uniformly fine-grained microstructures after either high-temperature or low-temperature processing and the application of a 15% cold reduction in conjunction with either annealing schedule (processing codes 2-3 and 2-4). With the exception of cold-forged and austenitized specimens of steel N1 (processing code 3-4, which exhibit grain coarsening in the shear band regions of the compression specimens, steels N1 and N2 exhibit fine-grained microstructures for all processing paths incorporating a 75% cold reduction.

A grain coarsening study was conducted on steel N2 to further investigate the effects of processing on the grain coarsening resistance of Nb—Al steels. Steel N2 exhibits fine-grained microstructures after a 15% cold reduction and austenitization in the 9541–1010° C. range for ten hours, irrespective of the specific process path prior to austenitization. Tables 32 and 33. Consistent with the fundamental explanation regarding the applicability of either high-temperature or low-temperature processing to high-nitrogen Nb—Al steels, FIG. 4, specimens of steel N2 exhibit equivalent grain coarsening resistance after the application of either type of hot-rolling, schedule, Tables 34 and 35. In particular, the cold-forged steel (processing code 3-4) exhibits abnormal grain coarsening in the shear band regions of the compression specimens after ten hours at 982° C., whereas the cold-forged and subcritically annealed specimens remain fine grained after ten hours at 1010° C. Similar to the Al steels and V—Al steels, grain coarsening in the Nb—Al steels is manifested as the occurrence of low densities of extremely coarse grains in the shear band regions of the compression specimens, and the remainder of the specimen volume, which is subjected to more uniform levels of plastic strain, is comprised of a uniformly fine-grained microstructure.

The results of a grain coarsening study on steel N3 after the application of high-temperature mill processing are summarized in Table 36. The high-temperature schedule for this steel consisted of reheating billets at about 1260° C. (i.e., below the Nb(C,N) solution temperature), hot rolling the billets to 52 mm bar, and air cooling the bars to room temperature. Specimens subjected to a 15% cold reduction exhibit fine-grained microstructures after austenitization for ten hours at temperatures up to 1010° C., once again independent of the specific annealing schedule applied to the steel (i.e. processing code 2-3 or 2-4). After the application of a 75% cold reduction, the subcritically annealed and austenitized specimens (processing code 3-3) exhibit fine-rained microstructures at 982° C., but the cold-forged and austenitized specimens (processing code 3-4) exhibit duplexed grain structures after ten hours at 954° C.

In comparing steels N2 and N3 after high-temperature processing and the application of a subcritical anneal (processing code 3-3), it is interesting to note that the grain coarsening temperature of steel N2 is greater than 1010° C., but grain coarsening in steel N3 occurs during the ten hour treatment at 1010° C. These data are consistent with the fact that steels N2 and N3 were solution treated at 1300° C. and ~1260° C., respectively, prior to hot rolling. The higher solution treatment temperature relative to the Nb(C,N) solution temperature in steel N2 provides greater amounts of solute for precipitation as fine particles during subsequent hot rolling and subcritical annealing, which in turn increases the grain coarsening resistance of the steel.

These examples have demonstrated the improvements achieved by several embodiments of the present invention. First, high-temperature processing provides superior grain coarsening resistance in high-nitrogen steels containing vanadium in combination with aluminum or aluminum as the sole grain-refining element. Second, either high-temperature or low-temperature processing is applicable to high-nitrogen steels containing niobium in combination with aluminum. Finally, the application of a subcritical anneal after cold forming increases the resistance to abnormal grain growth during subsequent austenitization for extended periods of time (e.g., carburization). These embodiments, in themselves, represent substantial improvements over the prior art with respect to maximizing the grain coarsening resistance of cold-formed and carburized steels for machine structural and automotive use; however, similar improvements in rain coarsening resistance also can be realized through the modification of the final subcritical anneaiinz treatment.

PROCESSES INCORPORATING RECOVERY ANNEALS

The results of a grain coarsening study on steel A3 are shown in Table 37 for specimens subjected to the high-temperature processing schedule, a 75% cold reduction, and either austenitization for ten hours (processing code 3-4) or the application of a subcritical anneal followed by austenitization for ten hours. Several annealing treatments were utilized in the latter processing schedule: (i) a recrystallization anneal at 720° C. for three hours (processing code 3-3), (ii) a single-stage recovery anneal at either 500° C. or 550° C. for three hours (processing code 4-3), and (iii) a two-stage recovery anneal consisting of reheating at either 500° C. or 550° C. for one and one-half hours followed by annealing at 720° C. for one and one-half hours (also designated processing code 4-3). Specimens subjected to a recrystallization anneal prior to austenitization (processing code 3-3) exhibit fine-grained microstructures at temperatures up to between 941° C. and 954° C., whereas the specimens austenitized directly after cold forging (processing code 3-4) exhibit minor amounts of abnormal grain growth (i.e., bimodal grain size distributions) at temperatures as low as 913° C. (the lowest austenitizing temperature evaluated for this particular processing path). The specimens subjected to a single-stage recovery anneal at either 500° C. or 550° C. exhibit minor amounts of abnormal grain growth after ten hours at 941° C., but abnormal grain growth is postponed to over 954° C. in specimens subjected to the two-stage annealing treatments (500° C. +720° C. or 530° C.+720° C.) prior to austenitization.

The results of a grain coarsening study on steels V1 and V3 are summarized in Tables 38 and 39 for specimens subjected to a single-stage anneal at 500° C. or a two-stage anneal at 500° C. and 720° C. The effects of processing on the development of grain coarsening resistance in steels V1 and V3 are similar to the results for steel A3 In comparison to the specimens subjected to a recrystallization anneal at 720° C. (processing code 3-3), which exhibit the greatest resistance to abnormal grain coarsening, Tables 23 and 25, specimens subjected to a two-stage recovery anneal (processing code 4-3) exhibit equivalent to slightly inferior grain coarsening resistance, Tables 38 and 39. Specimens subjected to a single-stage recovery anneal at 500° C. possess slightly inferior grain coarsening resistance, and the specimens austenitized directly after cold forging once again exhibit the lowest grain coarsening temperatures.

Figure 8:
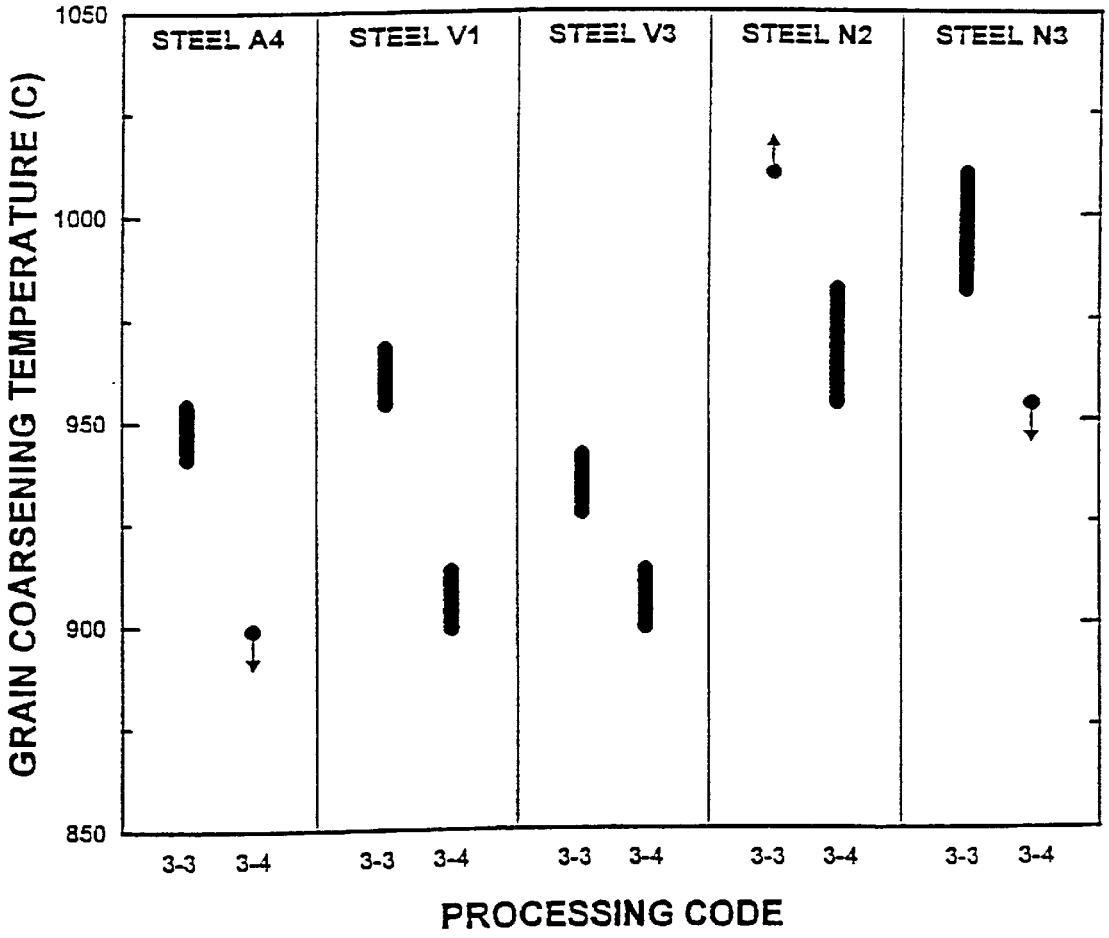
FIG. 8 is a graph showing the grain coarsening temperature for various high-nitrogen steels containing niobium and aluminum, vanadium and aluminum, and aluminum as the sole grain-refining element, wherein the steels were processed utilizing the high-temperature processing schedule of the present invention.
Figure 9:
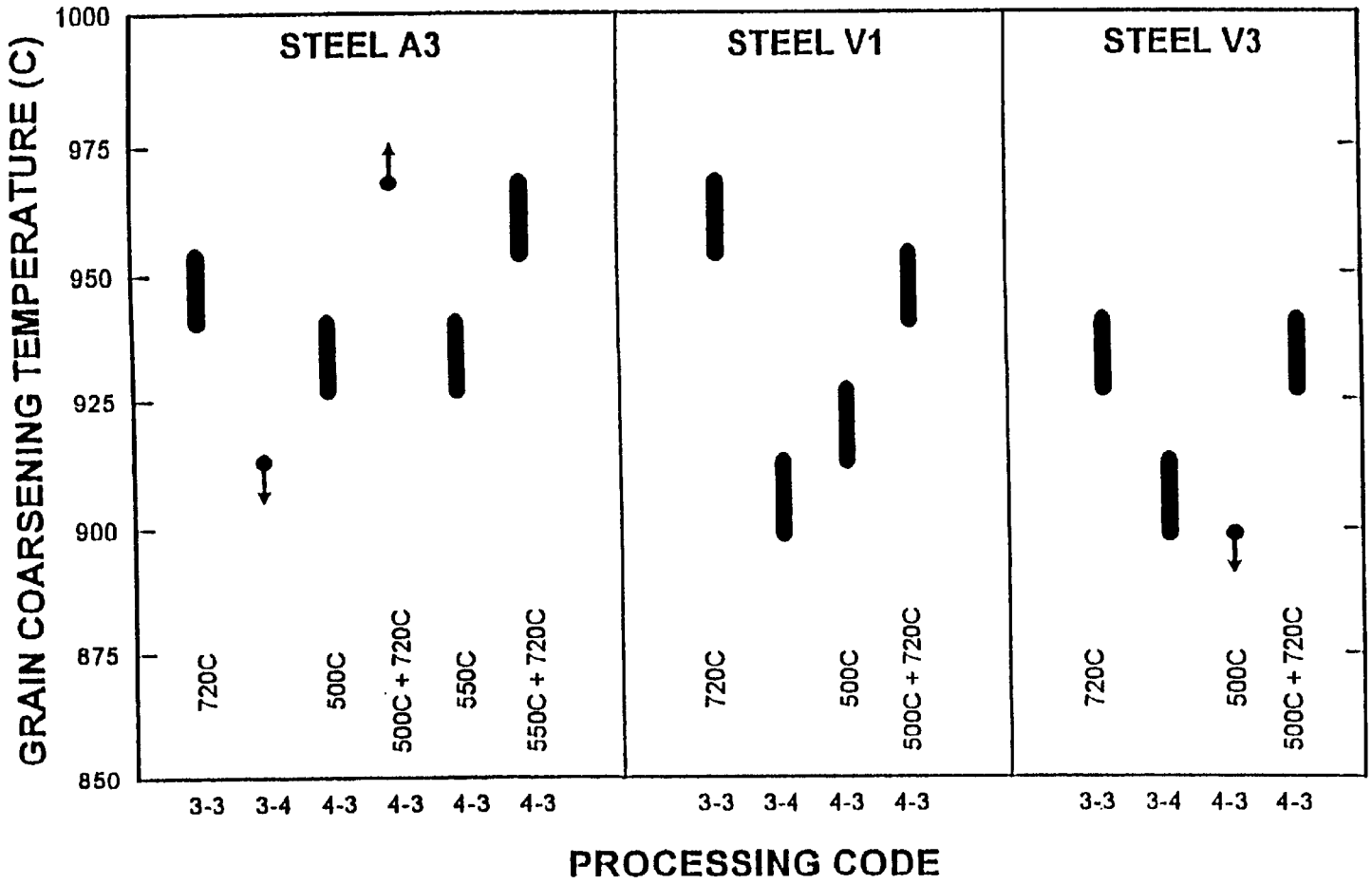
FIG. 9 is a graph showing the grain coarsening temperature for specimen steels A3, V1 and V3 subjected to the high-temperature processing schedule, cold-forging (75% reduction), and austenitization for ten hours (processing code 3-4) or the application of a recrystallization anneal (processing code 3-3) or either a single-stage or two-stage recovery anneal (processing code 4-3) prior to austenitization for ten hours.

The improvements in grain coarsening resistance associated with the incorporation of a subcritical anneal after the (final) cold-forging operation are derived from a reduction in internal strain energy prior to carburization. For the case of subcritical annealing at temperatures above 600° C. (i.e., recrystallization anneals), recrystallization of the cold-worked ferritic microstructure along with some redistribution and coarsening of iron/alloy carbides generates a precursor microstructure that optimizes austenite grain coarsening resistance during subsequent carburization, FIG. 8. The reduction in internal energy via recovery processes, which also provides good grain coarsening resistance, can be accomplished with a single-stage anneal at lower temperatures (approximately 500° C.) or a multiple-stage subcritical anneal at progressively increasing temperatures. In general terms, the objective of any type of recovery or recrystallization anneal after the last cold-forging operation is to reduce the internal strain energy of the ferritic microstructure prior to carburization. The results contained herein have shown that the complete recrystallization and limited coarsening of the ferritic microstructure provides the greatest resistance to grain coarsening during carburization, FIG. 8, although the application of two-stage or multiple-stage recovery anneals at progressively increasing temperatures will also provide fairly good grain coarsening resistance during carburization. FIG. 9. The application of an isothermnal recovery anneal at low temperatures is associated with a somewhat lower level of grain coarsening resistance than that which develops through the application of the other annealing treatments; however, the level of grain coarsening resistance is greater than if the steel is austenitized directly after cold forging (processing code 3-4).

Figure 10B:
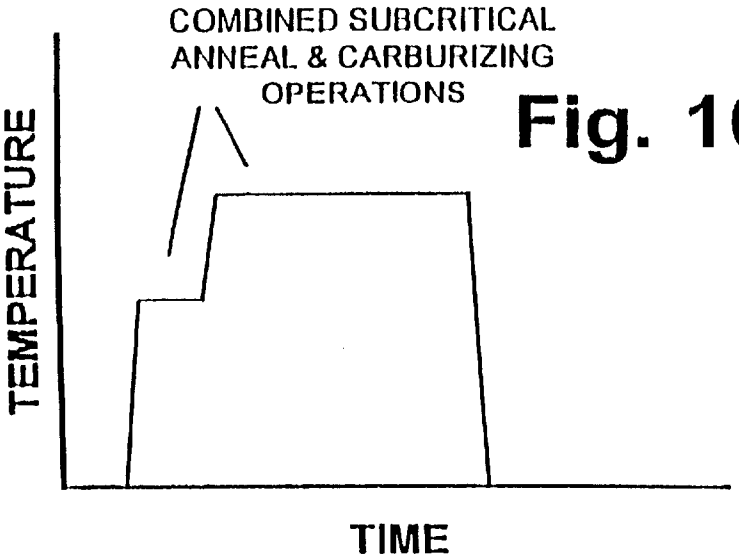
FIGS. 10*a*–10*c* are schematic illustrations of various methods of applying the subcritical annealing treatment prior to carburizing in accordance with the present invention.
Figure 10A:
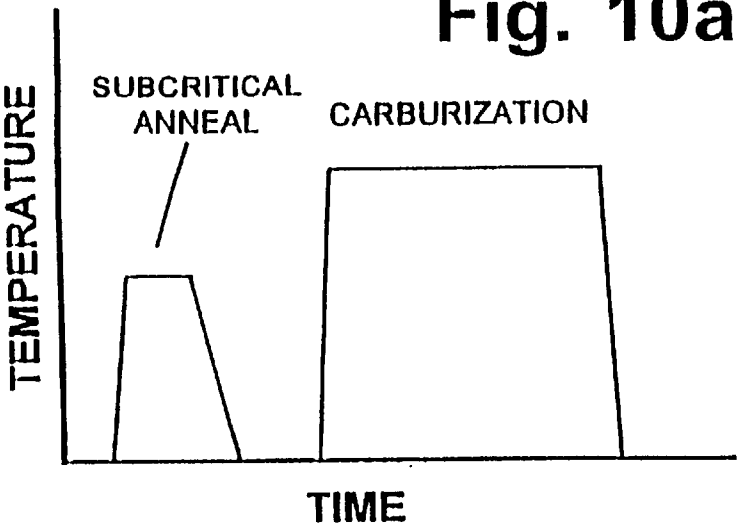
Figure 10C:
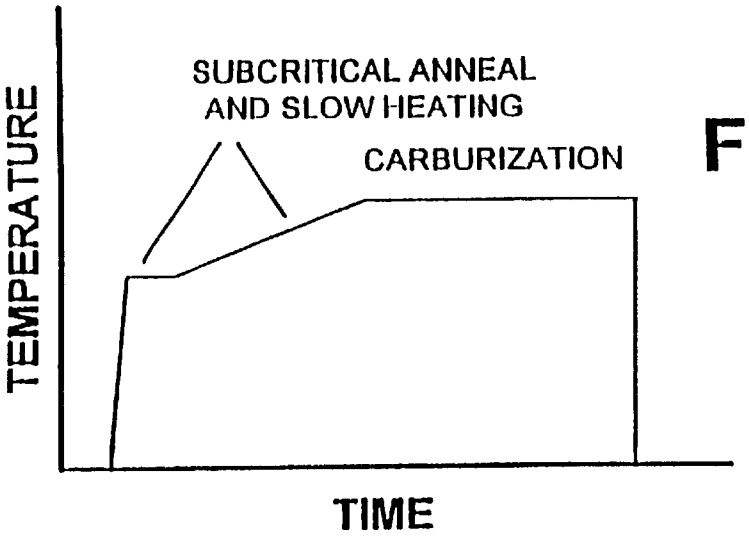

Normalizing prior to carburization is known to alleviate the propensity for severe abnormal grain coarsening in cold-formed components through the transformation-induced reduction in internal strain energy, but normalizing is both impractical and inferior to subcritical annealing in two respects. First, normalizing decreases the resistance to subsequent grain coarsening relative to subcritical annealing as a result of the increased potential for precipitate coarsening in austenite at substantially lower levels of equilibrium precipitate volume fraction (e.g., FIGS. 2*b* and 3*b*). Second, normalizing requires both reheating through the $\alpha \rightarrow \gamma$ transformation to reduce the internal strain energy and cooling through the $\gamma \rightarrow \alpha$ transformation to provide a precursor microstructure for the subsequent carburizing operation, thereby requiring the incorporation of a completely separate thermal treatment prior to carburizing,. In contrast, a subcritical anneal can be easily integrated into the processing of cold-formed components when a multiple-zone furnace is utilized for carburizing, FIG. 10. Although maximum grain coarsening resistance is derived from the application of the high-temperature processing schedule in conjunction with a subcritical anneal after the last cold-forming operation (processing code 3-3), moderate grain coarsening resistance can still be obtained through the application of the high-temperature processing schedule when it is not economically viable to utilize a subcritical anneal (processing code 3-4).

HARDNESS AND COLD FORMABILITY

It has been reported in the prior art, such as by Yangiva et al. that the comparatively high as-transformed hardness of steels hot rolled at high temperatures is detrimental to cold forgeability and die life. The hardness data for steels of the present investigation, Tables 40–42, parallel the findings of previous investigators in that the as-rolled hardness of steels processed at high temperatures tends to be higher than the hardness of steels processed at low temperatures, particularly for high-nitrogen steels containing niobium and aluminum. However, when high-temperature reheating and hot rolling is followed by subcritical annealing, as required in the processes of the present invention, the hardness is lowered to levels that characteristically provide good formability in steels with appropriate sulfur and oxygen contents. Moreover, the cold formability of hot-rolled and subcritically annealed steels is not affected by the hot-rolling schedule, as indicated by the formability data shown in Table 43 for the production steels of the present invention. The insensitivity of cold formability to prior processing persists even when the two material conditions exhibit a substantial difference in annealed hardness (e.g., the specimens of steel N2).

It should be understood that the present invention is not limited to the specific embodiments herein described, and the steel compositions and processes of the present invention can be utilized in other ways without departure from the spirit and fundamental understanding that underlies the manufacture of cold-formed and carburized components with fine-rained microstructures.

TABLE 1

| | | Steel Chemistries (weight percentages) | | | | | | | | | | | | | |
|---|---|---|---|---|---|---|---|---|---|---|---|---|---|---|---|
| Steel | Source | C | Mn | Si | Cr | Ni | Mo | P | S | Al | Nb | V | N (ppm) | O (ppm) | Eff. Al[1] |
| A1 | Production | 0.21 | 0.87 | 0.28 | 0.61 | 0.40 | 0.28 | 0.009 | 0.019 | 0.030 | | — | 84 | 12 | 0.029 |
| A2 | VIM | 0.20 | 0.87 | 0.10 | 1.11 | 0.17 | 0.15 | 0.012 | 0.015 | 0.033 | — | — | 182 | 41 | 0.028 |
| A3 | VIM | 0.22 | 0.89 | 0.11 | 1.08 | 0.17 | 0.15 | 0.011 | 0.012 | 0.045 | — | — | 195 | 36 | 0.041 |
| A4 | Production | 0.21 | 0.88 | 0.25 | 0.61 | 0.45 | 0.29 | 0.010 | 0.018 | 0.031 | — | — | 174 | 6 | 0.030 |
| V1 | VIM | 0.20 | 0.86 | 0.10 | 1.09 | 0.17 | 0.15 | 0.012 | 0.017 | 0.034 | — | 0.09 | 184 | 41 | 0.029 |
| V2 | VIM | 0.22 | 0.86 | 0.11 | 1.11 | 0.18 | 0.15 | 0.011 | 0.014 | 0.038 | — | 0.10 | 197 | 30 | 0.035 |
| V3 | VIM | 0.21 | 0.86 | 0.10 | 1.10 | 0.16 | 0.15 | 0.012 | 0.017 | 0.032 | — | 0.12 | 152 | 68 | 0.024 |
| V4 | VIM | 0.22 | 0.87 | 0.11 | 1.12 | 0.17 | 0.15 | 0.012 | 0.014 | 0.030 | — | 0.14 | 148 | 37 | 0.026 |
| V5 | VIM | 0.21 | 0.87 | 0.10 | 1.14 | 0.18 | 0.15 | 0.013 | 0.015 | 0.033 | — | 0.11 | 176 | 54 | 0.027 |
| V6 | VIM | 0.23 | 0.87 | 0.11 | 1.12 | 0.17 | 0.15 | 0.013 | 0.014 | 0.030 | — | 0.14 | 197 | 71 | 0.022 |
| N1 | VIM | 0.21 | 0.87 | 0.10 | 1.13 | 0.18 | 0.15 | 0.012 | 0.011 | 0.031 | 0.03 | — | 185 | 38 | 0.027 |
| N2 | Production | 0.18 | 0.82 | 0.22 | 1.24 | 0.10 | 0.13 | 0.007 | 0.015 | 0.033 | 0.03 | — | 202 | 12 | 0.032 |
| N3 | Production | 0.21 | 0.86 | 0.26 | 0.62 | 0.40 | 0.20 | 0.012 | 0.018 | 0.028 | 0.04 | — | 211 | 11 | 0.027 |

[1]The effective aluminum content is calculated as $[Al]_{EFF} = [Al] - 1.12[O]$.

TABLE 2

| | Summary of Austenite Grain Coarsening Data for Steel A1 (Low-Temperature Processing Schedule)[1] | | |
|---|---|---|---|
| Processing | Austenite Grain Size (ASTM #) | | |
| Code | Central Section of Specimen | Shear Band Regions | Comments |
| 1–2 (15%) | 9–10(7,8) [>99%] & 0 [<1%] | — | Predominantly fine-grained microstructure with isolated occurrences of ASTM 0. |
| 2–3 (15%) | 7–9 [50–60%] & −2,−1,0,1,2 [40–50%] | — | Severely duplexed grain structure |
| 2–4 (15%) | 8–9 [~30%] & −2,0,1,2,3 [~70%] | — | Severely duplexed grain structure. |
| 3–3 (75%) | 7–9 [15–50%] & −2,−1,1,2 [50–85%] | — | Severely duplexed grain structure. |
| 3–4 (75%) | 7–8(5,6,9) [100%] | — | Predominantly fine-grained microstructure with a broad range of grain size (i.e., isolated occurrences of ASTM 5–6). |

[1]Refer to FIG. 6 for definition of the various processing schedules.

TABLE 3

| | Summary of Austenite Grain Coarsening Data for Steel A1 (High-Temperature Processing Schedule)[1] | | |
|---|---|---|---|
| Processing | Austenite Grain Size (ASTM #) | | |
| Code | Central Section of Specimen | Shear Band Regions | Comments |
| 1–2 (15%) | 8–10(7) [100%] | — | Predominantly fine-grained microstructure with a broad range of grain size. |
| 2–3 (15%) | 8–10(7) [100%] | — | Predominantly fine-grained microstructure with a broad range of grain size. |
| 2–4 (15%) | 9–10(3) [100%] | — | Uniformly fine-grained microstructure with isolated occurrences of ASTM 8. |
| 3–3 (75%) | 9–10 [~25%]& −2,1 [~75%] | 9–10 & −2,−1,0 | Severely duplexed grain structure in both the central section and shear band regions of the structures. |
| 3–4 (75%) | 8–10(6–7) [>95%] & 4,5,6 [<5%] | 8–9(7) & 2–3(4,5) | Microstructures ranging from fine-grained to slightly duplexed in the central section of the specimens. Abnormal grain coarsening present in the shear band regions of the specimens. |

[1]Refer to FIG. 6 for definition of the various processing schedules.

TABLE 4

Summary of Austenite Grain Coarsening Data for Steel A2 (Low-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 8–9(7) [100%] | — | Uniformly fine-grained microstructure. |
| 2–3 (15%) | 7–8(9) [100%] | — | Uniformly fine-grained microstructure. |
| 2–4 (15%) | 7–8 [100%] | — | Uniformly fine-grained microstructure. |
| 3–3 (75%) | 8–10(7) [10–60%] & −2,−1,0,1,2 [40–90%] | — | Severely duplexed grained structure. |
| 3–4 (75%) | 7–8(6,9,10) [75–90%] & 3–4(1,2,5) [10–25%] | — | Severely duplexed grained structure. |

[1]Refer to FIG. 6 for definition of the various processing schedules.

TABLE 5

Summary of Austenite Grain Coarsening Data for Steel A2 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10(8) [100%] | — | Predominantly fine-grained microstructure with a broad range of grain size. |
| 2–3 (15%) | 9–10(8,11) [100%] | — | Uniformly fine-grained microstructure. |
| 3–3 (75%) | 8–9(10) [100%] | 9–10 (11) & −2,−1,0,1 | Fine-grained microstructure in the central section of the specimens with severe abnormal grain coarsening in the shear band regions of the specimens. |
| 3–4 (75%) | 9–10(7,8) [>95%] & 4–6 [<5%] | — | Uniformly duplexed grain structure. |

[1]Refer to FIG. 6 for definition of the various processing schedules.

TABLE 6

Summary of Austenite Grain Coarsening Data for Steel A3 (Low-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10(8,7) [100%] | — | Fine-grained microstructure with isolated occurrences of ASTM 7. |
| 2–3 (15%) | 7–8(6) [100%] | — | Fine-grained microstructure with isolated occurrences of ASTM 6. |
| 2–4 (15%) | 7–8(9) [100%] | — | Uniformly fine-grained microstructure. |
| 3–3 (75%) | 9–10 [5–20%] & −2,−1,0 [80–95%] | — | Severely duplexed grain structure. |
| 3–4 (75%) | 7–8(6,9) [100%]/ 6–7(4,5,8) [100%] | — | Fine-grained microstructure containing regions of abnormal grain growth. |

[1]Refer to FIG. 6 for definition of the various processing schedules.

TABLE 7

Summary of Austenite Grain Coarsening Data for Steel A3 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10 [100%] | — | Uniformly fine-grained microstructure. |
| 2–3 (15%) | 7–8(9) [100%] | — | Fine-grained microstructure with a broad range of grain size. |
| 2–4 (15%) | 8–9(10) [100%] | — | Uniformly fine-grained microstructure. |
| 3–3 (75%) | 9–10(11) [100%] | 9–10 & −2,−1 | Fine-grained microstructure in the central section of the specimens with severe grain coarsening in the shear band regions of the specimens. |

TABLE 7-continued

| Summary of Austenite Grain Coarsening Data for Steel A3 (High-Temperature Processing Schedule)[1] | | | |
|---|---|---|---|
| Processing | Austenite Grain Size (ASTM #) | | |
| Code | Central Section of Specimen | Shear Band Regions | Comments |
| 3–4 (75%) | 8–9(7,10) [>95%] & 5–6 [<5%] | — | Uniformly duplexed grain structure. |

[1]Refer to FIG. 6 for definition of the various processing schedules.

TABLE 8

| Summary of Austenite Grain Coarsening Data for Steel A4 (High-Temperature Mill Processing Schedule)[1] | | | | |
|---|---|---|---|---|
| Processing | Austenitizing | Austenite Grain Size (ASTM #) | | |
| Code | Temperature (° C.) | Central Section of Specimen | Shear Band Regions | Comments |
| 2–3 (15%) | 899 | 8–9 [100%] | — | Uniformly fine-grained microstructure. |
| 2–4 (15%) | 899 | 9–10 [100%] | — | Uniformly fine-grained microstructure. |
| 2–3 (15%) | 913 | 9–10(7,8) [100%] | — | Fine-grained microstructure with relatively infrequent occurrences of ASTM 7. |
| 2–4 (15%) | 913 | 9–10(8) [100%] | — | Uniformly fine-grained microstructure. |
| 2–3 (15%) | 927 | 9–10(7,8) [100%] | — | Fine-grained microstructure with relatively infrequent occurrences of ASTM 7. |
| 2–4 (15%) | 927 | 9–10(8) [100%] | — | Uniformly fine-grained microstructure. |
| 2–3 (15%) | 941 | 9–10(8) [100%] | — | Uniformly fine-grained microstructure. |
| 2–4 (15%) | 941 | 9–10(7,8) [100%] | — | Fine-grained microstructure with relatively infrequent occurrences of ASTM 7. |
| 2–3 (15%) | 954 | 9–10(7,8) [100%] | — | Fine-grained microstructure with isolated occurrences of ASTM 7. |
| 2–4 (15%) | 954 | 9–10(7,8) [100%] | — | Fine-grained microstructure with relatively infrequent occurrences of ASTM 7. |
| 2–3 (15%) | 968 | 9–10(6,7,8) [100%] | — | Predominantly fine-grained microstructure with relatively infrequent occurrences of ASTM 6–7. |
| 2–4 (15%) | 968 | 9–10(7,8) [100%] | — | Fine-grained microstructure with relatively infrequent occurrences of ASTM 7. |

[1]Refer to FIG. 6 for definition of the various processing schedules. All specimens were austenitized at the indicated temperatures for ten hours.

TABLE 9

| Summary of Austenite Grain Coarsening Data for Steel A4 (High-Temperature Mill Processing Schedule)[1] | | | | |
|---|---|---|---|---|
| Processing | Austenitizing | Austenite Grain Size (ASTM #) | | |
| Code | Temperature (° C.) | Central Section of Specimen | Shear Band Regions | Comments |
| 3–3 (75%) | 899 | 9–10 [100%] | — | Uniformly fine-grained microstructure. |
| 3–4 (75%) | 899 | 9–10 [100%] | 6–7(5) | Uniformly fine-grained microstructure in the central section of the specimens with abnormal grain coarsening in the shear band regions of the specimens. |
| 3–3 (75%) | 913 | 9–10 [100%] | — | Uniformly fine-grained microstructure. |
| 3–4 (75%) | 913 | 9–10(8) [100%] | 9–10(6,7,8) | Uniformly fine-grained microstructure in the central section of the specimens with abnormal grain coarsening in the shear band regions of the specimens. |
| 3–3 (75%) | 927 | 9–10 [100%] | — | Uniformly fine-grained microstructure. |
| 3–4 (75%) | 927 | 9–10(8) [90–95%] & 5–7(3,4) [5–10] | — | Predominantly fine-grained with regions of abnormal grain coarsening. |
| 3–3 (75%) | 941 | 9–10 [100%] | — | Uniformly fine-grained microstructure. |
| 3–4 (75%) | 941 | 9–10(7) [>99%] & 5–6 [<1%] | 9–10 [6–90%] & 5–6(4) [10–40%] | Predominantly fine-grained microstructure with isolated occurrences of ASTM 5–6 in the central section of the specimens. Duplex grain structure in the shear band regions of the specimens. |

TABLE 9-continued

Summary of Austenite Grain Coarsening Data for Steel A4 (High-Temperature Mill Processing Schedule)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 954 | 9–10 [100%] | >1,1,3 | Uniformly fine-grained microstructure of the central section of the specimens. Severe grain coarsening in the shear band regions of the specimens. |
| 3–4 (75%) | 954 | 9–10(4,5,6,7) | — | Duplexed grain structure. |
| 3–3 (75%) | 968 | 9–10 [100%] | >1 | Uniformly fine-grained microstructure in the central section of the specimens. Severe grain coarsening in the shear band regions of the specimens. |
| 3–4 (75%) | 968 | 9–10 [70–80%] & 4–6(2,3) [20–30%] | — | Duplexed grain structure. |

[1]Refer to FIG. 6 for definition of the various processing schedules. All specimens were austenitized at the indicated temperatures for ten hours.

TABLE 10

Summary of Austenite Grain Coarsening Data for Steel V1 (Low-Temperature Processing Schedule)[1]

| Processing Code | Austenite Grain Size (ASTM #) Central Section of Specimen | Shear Band Regions | Comments |
|---|---|---|---|
| 1–2 (15%) | 9–10 [100%]/ 9–10(8) [>99%] & −2,−1 [<1%] | — — | Microstructures ranging from uniformly fine grained to predominantly fine grained with occurrences of extremely coarse grains. |
| 2–3 (15%) | 7–8(9) [>95%] & −2,−1,0,1,3,4 [<5%] | — | Severely duplexed grain structure. |
| 2–4 (15%) | 7–8 [100%]/7–8(9) [<95%] & 3–4(1,5) [<5%] | — | Microstructures ranging from uniformly fine grained to predominantly fine grained with occurrences of extremely coarse grains. |
| 3–3 (75%) | 8–9 [10–50%] & −2,−1,0,1 [50–90%] | 9–10 & −2,−1,0,1 | Severely duplexed grain structure in both the central and shear band regions of the specimens. |
| 3–4 (75%) | 6,7,9(5) [60–85%] & 1,−2,(−1,0) [15–40%] | — | Severely duplexed grain structure. |

[1]Refer to FIG. 6 for definition of the various processing schedules.

TABLE 11

Summary of Austenite Grain Coarsening Data for Steel V1 (High-Temperature Processing Schedule)[1]

| Processing Code | Austenite Grain Size (ASTM #) Central Section of Specimen | Shear Band Regions | Comments |
|---|---|---|---|
| 1–2 (15%) | 9–10 [100%] | — | Uniformly fine-grained microstructure. |
| 2–3 (15%) | 7–8(9) [100%] | — | Uniformly fine-grained microstructure. |
| 2–4 (15%) | 8–9(10) [100%] | — | Uniformly fine-grained microstructure. |
| 3–3 (75%) | 8–9 [100%)] | — | Uniformly fine-grained microstructure. |
| 3–4 (75%) | 9–10(7,8) [100%] | — | Fine-grained microstructure with a broad range of grain size. |

[1]Refer to FIG. 6 for definition of the various processing schedules.

TABLE 12

Summary of Austenite Grain Coarsening Data for Steel V2 (Low-Temperature Processing Schedule)[1]

| Processing Code | Austenite Grain Size (ASTM #) Central Section of Specimen | Shear Band Regions | Comments |
|---|---|---|---|
| 1–2 (15%) | 8–9(10) & −2,−1,0,1,3 | — | Severely duplexed with discrete regions of extremely large grains. |
| 2–3 (15%) | 7–8 [100%] | — | Uniformly fine-grained microstructure. |

TABLE 12-continued

Summary of Austenite Grain Coarsening Data for Steel V2 (Low-Temperature Processing Schedule)[1]

| Processing | Austenite Grain Size (ASTM #) | | |
|---|---|---|---|
| Code | Central Section of Specimen | Shear Band Regions | Comments |
| 2–4 (15%) | 6-7(8) [~95%] & 1,0,1 [~5%]/ 9–10(8,7) [100%] & −2,−1,1,2,4 [~20%] | — | Grain structures ranging from severely duplexed to fine grained with isolated regions of extremely coarse grains. |
| 3–3 (75%) | 7–9 [10–60%] & −2,−1 [40–90%] | — | Severely duplexed grain structure. |
| 3–4 (75%) | 5–7,8–9 [~95%] & 1–2(−1,0,3) [~5%] | — | Severely duplexed grain structure. |

[1]Refer to FIG. 6 for definition of the various processing schedules.

TABLE 13

Summary of Austenite Grain Coarsening Data for Steel V2 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10(8) [100%] | — | Uniformly fine-grained microstructure with isolated occurrences of ASTM 8. |
| 2–3 (15%) | 9–10(8,11,12) [100%] | — | Fine-grained microstructure with a broad range of grain size. |
| 2–4 (15%) | 9–10(11,12) [100%] | — | Fine-grained microstructure with a broad range of grain size. |
| 3–3 (75%) | 8–9(10) [100%] | — | Uniformly fine-grained microstructure. |
| 3–4 (75%) | 9–10 [100%] | 4–5(3) | Uniformly fine-grained microstructure in the central section of the specimens with abnormal grain coarsening in the shear band regions of the specimens. |

[1]Refer to FIG. 6 for definition of the various processing schedules.

TABLE 14

Summary of Austenite Grain Coarsening Data for Steel V3 (Low-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 8–9 [~10%] & −2,−1 [~90%] | — | Severely duplexed grain structure. |
| 2–3 (15%) | 8–9 [<5%] & −2,−1,0,1 [>95%] | — | Severely duplexed grain structure. |
| 2–4 (15%) | 6,7,8 [~20%] & 2,−1,0,1(4,5) [~80%] | — | Severely duplexed grain structure. |
| 3–3 (75%) | 7–10 [10–20%] & −2,−1,1,3–5 [80–90%] | — | Severely duplexed grain structure. |
| 3–4 (75%) | 8–9(5,7) [80–90%] & 2–3(1,4) [10–20%] | — | Severely duplexed grain structure. |

[1]Refer to FIG. 6 for definition of the various processing schedules.

TABLE 15

Summary of Austenite Grain Coarsening Data for Steel V3 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10 [100%] | — | Uniformly fine-grained microstructure. |
| 2–3 (15%) | 7–8(9) [100%] | — | Uniformly fine-grained microstructure. |
| 2–4 (15%) | 8–9(7) [100%] | — | Uniformly fine-grained microstructure. |
| 3–3 (75%) | 9–10(8,11) [100%] | 9–10(8) & −2,−1,0,3,4 | Fine-grained microstructure in the central section of the specimens with abnormal grain coarsening in the shear band regions of the specimens. |
| 3–4 (75%) | 9–10(11) [50–80%] & 1,2(3,4) [20–50%] | — | Severely duplexed grain structure. |

[1]Refer to FIG. 6 for definition of the various processing schedules.

TABLE 16

Summary of Austenite Grain Coarsening Data for Steel V4 (Low-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9 [~5%] & −2,−1,0 [~95%] | — | Severely duplexed grain structure. |
| 2–3 (15%) | 7–9 [~15%] & 0–3 [~85%] | — | Severely duplexed grain structure. |
| 2–4 (15%) | −2,−1,0,1 [100%] | — | Extremely coarse-grained microstructure. |
| 3–3 (75%) | 8–10 [20–30%] & 0–6 [70–80%] | — | Severely duplexed grain structure. |
| 3–4 (75%) | 9–10 [80–90%] & 2–4(1,5) [10–20%] | 1,2,4 | Duplexed grain structure in the central section of the specimens with more severe grain coarsening in the shear band regions of the specimens. |

[1]Refer to FIG. 6 for definition of the various processing schedules.

TABLE 17

Summary of Austenite Grain Coarsening Data for Steel V4 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10(8) [100%] | — | Uniformly fine-grained microstructure with isolated occurrences of ASTM 8. |
| 2–3 (15%) | 8–10(11) [100] | — | Uniformly fine-grained microstructure. |
| 2–4 (15%) | 9–10(8) [100%] | — | Uniformly fine-grained microstructure. |
| 3–3 (75%) | 8–9(7) [100] | — | Predominantly fine-grained microstructure. A single grain of size ASTM 4 was observed in the shear band region in one of three specimens. |
| 3–4 (75%) | 8–10(7) [100%]/ 7–9(5,6) [100%] | 9–10 & 1–3(4) | Microstructures ranging from fine grained with a broad range of grain size to duplexed in the center of the specimens with more severe grain coarsening evident in the shear band regions of the specimens. |

[1]Refer to FIG. 6 for definition of the various processing schedules.

TABLE 18

Summary of Austenite Grain Coarsening Data for Steel V5 (Low-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 10 [35–40%] & −2,−1,0,1 [55–60%] | — | Severely duplexed grain structure. |
| 2–3 (15%) | 8–9 [70–80%] & −2,−1,0,1,2 [20–30%] | — | Severely duplexed grain structure. |
| 2–4 (15%) | 9–10 [~5%] & −2,−1,0 [~95%] | — | Severely duplexed grain structure. |
| 3–3 (75%) | 7–8 [10–50%] & −2,−1,0 [50–90%] | — | Severely duplexed grain structure. |
| 3–4 (75%) | 9–10 [80–90%] & 2–4(1,5) [10–20%] | — | Severely duplexed grain structure. |

[1]Refer to FIG. 6 for definition of the various processing schedules.

TABLE 19

Summary of Austenite Grain Coarsening Data for Steel V5 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10(8) [100%] | — | Uniformly fine-grained microstructure with isolated occurences of ASTM 8 |

TABLE 19-continued

Summary of Austenite Grain Coarsening Data for Steel V5 (High-Temperature Processing Schedule)[1]

| Processing Code | Austenite Grain Size (ASTM #) Central Section of Specimen | Shear Band Regions | Comments |
|---|---|---|---|
| 2–3 (15%) | 8–9(7) [100%] | — | Uniformly fine-grained microstructure with moderately frequent occurrences of ASTM 7. |
| 2–4 (15%) | 9–10(8) [100%] | — | Uniformly fine-grained microstructure with isolated occurrences of ASTM 8. |
| 3–3 (75%) | 9–10/10–11 [100%] | 3–4(2) | Uniformly fine-grained microstructure in the central section of the specimens. Abnormal grain coarsening evident in the shear band regions in two of three specimens. |
| 3–4 (75%) | 9–10(5,6,8)/6–9(5,10) [100%] | 9–10 & 3–4(2) | Duplexed grain structure in the central section of the specimens with more severe grain coarsening in the shear band regions of the specimens. |

[1]Refer to FIG. 6 for definition of the various processing schedules.

TABLE 20

Summary of Austenite Grain Coarsening Data for Steel V6 (Low-Temperature Processing Schedule)[1]

| Processing Code | Austenite Grain Size (ASTM #) Central Section of Specimen | Shear Band Regions | Comments |
|---|---|---|---|
| 1–2 (15%) | 9–10 [~15%] & −2,−1,0,1 [~85%] | — | Severely duplexed grain structure. |
| 2–3 (15%) | 5–10 [~50%] & −1,1,2 [~50%] | — | Severely duplexed grain structure. |
| 2–4 (15%) | 9–10(7,8) [~40%] & −1,1,2,3(5,6) [~60%] | — | Severely duplexed grain structure. |
| 3–3 (75%) | 7–8 [10–50%] & −2,0,1 [50–90%] | — | Severely duplexed grain structure. |
| 3–4 (75%) | 8–10 [100%] & 9–10(5,6.7) [70–100%] & 3–4(1,2) (0.30%) | 8–9 [100%] & 9–10 (95–100%) & 2(1) [0–5%] | Severely duplexed grain structure. Abnormal grain coarsening evident in the shear band regions of the specimens. |

[1]Refer to FIG. 6 for definition of the various processing schedules.

TABLE 21

Summary of Austenite Grain Coarsening Data for Steel V6 (High-Temperature Processing Schedule)[1]

| Processing Code | Austenite Grain Size (ASTM #) Central Section of Specimen | Shear Band Regions | Comments |
|---|---|---|---|
| 1–2 (15%) | 9–10 [100%] | — | Uniformly fine-grained microstructure. |
| 2–3 (15%) | 9–10(8) [100%] | — | Fine-grained microstructure with a moderately wide range of grain size. |
| 2–4 (15%) | 8–9(10) [100%] | — | Fine-grained microstructure with a moderately wide range of grain size. |
| 3–3 (75%) | 9–10 [100%] | 3–5 | Predominantly fine-grained microstructure. Observation of a band of ASTM 3–5 along a forging flow line in one of three compression specimens. |
| 3–4 (75%) | 9–10(11) [100%]/ 9–10(11) [~90%] & 6–7(5) [~10%] | 9–11 & 1,2,3,4,5 | Predominantly fine grained in the central section of the specimens with isolated regions of abnormal grain coarsening (ASTM 5–7). Grain coarsening evident in the shear band regions of the specimens. |

[1]Refer to FIG. 6 for definition of the various processing schedules.

TABLE 22

Summary of Austenite Grain Coarsening Data for Steel V1
(Low-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 9–10 [100%] | 9–10(8) [~80%] & >1,1–3 [~20%] | Fine-grained microstructure in the central section and duplexed (i.e., relatively low density of coarse grains) in the shear band regions of the specimens. |
| 3–4 (75%) | 899 | 8–10 [~90%] & 3–5 [~10%] | — | Uniformly duplexed grain structure with a relatively low density of coarse grains. |
| 3–3 (75%) | 913 | 7–8 [100%] | 7–8 [~40%] & >1,1–3 [~60%] | Fine-grained microstructure in the central sections and severely duplexed in the shear band regions of the specimens. |
| 3–4 (75%) | 913 | 7–8(6) [~90%] & 3–4 [~10%] | — | Duplexed grain structure comprised mainly of fine grains with a low density of coarser grains. |
| 3–3 (75%) | 927 | 7–8 [100%] | 5–6(7) [~20%] & >1,1,2 [~80%] | Fine-grained microstructure in the central section and severely duplexed in the shear band regions of the specimens. |
| 3–4 (75%) | 927 | 7–8 [~85%) & 2–4 [~15%] | — | Uniformly duplexed grain structure. |
| 3–3 (75%) | 941 | 7–8 [100%] | 6–7(8) [~10%] & >1,1–3(4) [~90%] | Fine-grained microstructure in the central section and severely duplexed in the shear band regions of the specimens. |
| 3–4 (75%) | 941 | 7–8(6) [~70%] & >1,1–3(4,5) [~30%] | — | Uniformly duplexed grain structure. |
| 3–3 (75%) | 954 | 8–9 [10–50%] & −2,−1,0,1 [50–90%] | 9–10 & −2,−1,0,1 | Severely duplexed grain structure in both the central and shear band regions of the specimens. |
| 3–4 (75%) | 954 | 6,7,9(5) [60–85%] & 1,−2,(−1,0) [15–40%] | — | Severely duplexed grain structure. |
| 3–3 (75%) | 968 | 5–6(7,8) [~5%] & >1,1,2 [~95%] | — | Severely duplexed grain structure. |
| 3–4 (75%) | 968 | 7–8(5,6) [~80%] & 2–3(1,4) [~20%] | — | Uniformly duplexed grain structure. |

[1]Refer to FIG. 6 for definition of the various processing schedules. All specimens were austenitized at the indicated temperatures for ten hours.

TABLE 23

Summary of Austenite Grain Coarsening Data for Steel V1
(High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 9–10(8) [100%] | — | Uniformly fine-grained microstructure. |
| 3–4 (75%) | 899 | 9–10(8) [>98%] & 6–7 [<2%] | — | Predominantly fine-grained microstructure containing infrequent occurrences of larger grains near the ends of one specimen. |
| 3–3 (75%) | 913 | 9–10(8) [100%] | — | Uniformly fine-grained microstructure. |
| 3–4 (75%) | 913 | 9–10 (>99%] & 6–7 [<1%] | — | Predominantly fine-grained microstructure containing slightly duplexed regions. |
| 3–3 (75%) | 927 | 9–10(8) [100%] | — | Uniformly fine-grained microstructure. |
| 3–4 (75%) | 927 | 9–10 [>95%] & 5–6(4) [<5%] | — | Predominantly fine-grained microstructure with moderately infrequent occurrences of larger grains. |
| 3–3 (75%) | 941 | 9–10(8) [100%] | — | Uniformly fine-grained microstructure. |
| 3–4 (75%) | 941 | 9–10 [90–95%] & 4–6(3) [5–10%] | | Duplexed grain structure containing moderately frequent occurrences of coarser grains. |
| 3–3 (75%) | 954 | 8–9 [100%] | — | Uniformly fine-grained microstructure. |
| 3–4 (75%) | 954 | 9–10(7,8) [100%] | — | Fine-grained microstructure with a broad range of grain size. |
| 3–3 (75%) | 968 | 9–10(8) [100%] | 5 | Uniformly fine-grained microstructure with some fine, non-eqilibrium shaped grains and a single occurrence of an ASTM 5 in the shear band region of one specimen. |
| 3–4 (75%) | 968 | 8–10 [75–80%] & >1,1–4 [20–25%] | — | Uniformly duplexed grain structure. |

[1]Refer to FIG. 6 for definition of the various processing schedules. All specimens were austenitized at the indicated temperatures for ten hours.

TABLE 24

Summary of Austenite Grain Coarsening Data for Steel V3 (Low-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 8–9 [100%] | 8–9[~80%] & >1,1–2 [~20%] | Fine-grained microstructure in the central section and duplexed (i.e., a low density of coarse grains) in the shear band regions of the specimens. |
| 3–4 (75%) | 899 | 7–8 [90–95%] & 3–5 [5–10%] | — | Uniformly duplexed grain structure with a relatively low density of coarse grains. |
| 3–3 (75%) | 913 | 7–8 [100%] | 7–8 [~30%] & >1,1–3 [~70%] | Fine-grained microstructure in the central section and severely duplexed in the shear band regions of the specimens. |
| 3–4 (75%) | 913 | 7–8(9) [~80%] & 2–4(1) [~20%] | — | Uniformly duplexed grain structure. |
| 3–3 (75%) | 927 | 8–9(7) [100%] | 8–9(7) [~20%] & >1,1–4 [~80%] | Fine-grained microstructure in the central section and severely duplexed in the shear and regions of the specimens. |
| 3–4 (75%) | 927 | 7–9 [~90%] & >1,1–4 [~10%] | — | Uniformly duplexed grain structure. |
| 3–3 (75%) | 941 | 7–8 [100%] | 5–8 [~10%] & >1,1–3 [~90%] | Predominantly fine grained in the central section and severely duplexed in the shear band regions of the specimens. |
| 3–4 (75%) | 941 | 7–8(6) [70–75%] & 2,4(1,5) [25–30%] | — | Uniformly duplexed grain structure. |
| 3–3 (75%) | 954 | 7–10 [10–20%] & −2,−1,1,3–5 [80–90%] | — | Severely duplexed grain structure. |
| 3–4 (75%) | 954 | 8–9(5,7) [80–90%] & 2–3(1,4) [10–20%] | — | Severely duplexed grain structure. |
| 3–3 (75%) | 968 | 5–7(8) [~10%] & 1–2(>1) (~90%] | — | Severely duplexed grain structure consisting of a low density of extremely coarse grains intermixed with fine grains. |
| 3–4 (75%) | 968 | 7–8 [~80%] & 2–4(5) [~20%] | — | Uniformly duplexed grain structure with a comparatively high density of coarser grains. |

[1]Refer to FIG. 6 for definition of the various processing schedules. All specimens were austenitized at the indicated temperatures for ten hours.

TABLE 25

Summary of Austenite Grain Coarsening Data for Steel V3 (High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 9–10(8) [100%] | — | Uniformly fine-grained microstructure. |
| 3–4 (75%) | 899 | 9–10(8) [>98%] & 6–7 [<2%] | — | Predominantly fine-grained microstructure containing infrequent occurrences of larger grains near the ends of the specimens. |
| 3–3 (75%) | 913 | 9–10(8) [100%] | — | Uniformly fine-grained microstructure. |
| 3–4 (75%) | 913 | 9–10 [70–90%] & 4–6 [10–30%] | — | Uniformly duplexed grain structure. |
| 3–3 (75%) | 927 | 9–10(8) [100%] | — | Uniformly fine-grained microstructure. |
| 3–4 (75%) | 927 | 9–10(8) [80–90%] & 3–6 [10–20%] | — | Uniformly duplexed grain structure containing relatively frequent occurrences of coarse grains. |
| 3–3 (75%) | 941 | 9–10(8) [100%] | 9–10 [>99%] & 4 [<<1%] | Uniformly fine-grained microstructure with isolated occurrences of ASTM 4 in the shear band regions of the specimens. |
| 3–4 (75%) | 941 | 9–10 (85–90%] & 1–5 [15–20%] | — | Severely duplexed grain structure. |
| 3–3 (75%) | 954 | 9–10(8,11) [100%] | 9–10(8) & −2,−1,0,3,4 | Fine-grained microstructure in the central section and severely duplexed in the shear band regions of the specimens. |
| 3–4 (75%) | 954 | 9–10(11) [50–80%] & 1–2(3,4) [20–50%] | — | Severely duplexed grain structure. |
| 3–3 (75%) | 968 | 9–10 [100%] | 9–10 [20–30%] & >1,1–2 [70–80%] | Fine-grained microstructure in the central section and severely duplexed in the shear band regions of the specimens. |

TABLE 25-continued

Summary of Austenite Grain Coarsening Data for Steel V3 (High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 968 | 9–10 [~40%] & >1,1–4 [~60%] | — | Severely duplexed grain structure. |

[1]Refer to FIG. 6 for definition of the various processing schedules. All specimens were austenitized at the indicated temperatures for ten hours.

TABLE 26

Summary of Austenite Grain Coarsening Data for Steel V6 (Low-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 8 [100%] | 8 [90–95%] & 2–3[5–10%] | Fine-grained microstructure in the central section and duplexed in the shear band regions of the specimens. |
| 3–4 (75%) | 899 | 8–9 [85–90%] & 3–5 [5–10%] | — | Uniformly duplexed grain structure with a relatively low density of coarser grains dispersed throughout the microstructure. |
| 3–3 (75%) | 913 | 7–8 [100%] | 7–8 [45–50%] & >1,1,2 [50–55%] | Fine-grained microstructure in the central section and severely duplexed in the shear band regions of the specimens. |
| 3–4 (75%) | 913 | 7–8 [~70%] & 2–4(1) [~30%] | — | Uniformly duplexed grain structure. |
| 3–3 (75%) | 927 | 8(7) [100%] | 5–8 [~10%] & >1,1–2 [~90%] | Fine-grained microstructure in the central section and severely duplexed in the shear band regions of the specimens. |
| 3–4 (75%) | 927 | 6–7 [~80%] & 2–4(1) [~20%] | — | Uniformly duplexed grain structure. |
| 3–3 (75%) | 941 | 7–8 [95–100%] & >1,1,3 [0–5%] | 6–8(5) [~50%] & >1,1,3,4 [~50%] | Low densities of large grains in the central section and severe grain coarsening in the shear band regions of the specimens. |
| 3–4 (75%) | 94 1 | 6–8(5) [~70%] & 1–3 [~30%] | — | Uniformly duplexed grain structure. |
| 3–3 (75%) | 954 | 7–8 [10–50%] & −2,0,1 [50–90%] | — | Severely duplexed grain structure. |
| 3–4 (75%) | 954 | 8–10 [100%]/9–10(5,6,7) [70–100%] & 3–4(1,2) [0–30%] | — | Severely duplexed grain structure. |
| 3–3 (75%) | 968 | 5–7 [~5%] & 1–2(>1) [~95%] | — | Severely duplexed grain structure consisting of a low density of extremely coarse grains intermixed with fine grains. |
| 3–4 (75%) | 968 | 7–8(6) [~90%] & 2–4(1) [~10%] | — | Uniformly duplexed grain structure with a comparatively high density of larger grains. |

[1]Refer to FIG. 6 for definition of the various processing schedules. All specimens were austenitized at the indicated temperatures for ten hours.

TABLE 27

Summary of Austenite Grain Coarsening Data for Steel V6 (High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 899 | 9–10 [90–95%] & 7–8 [5–10%] | — | Fine-grained microstructure with occurrences of coarser (ASTM 7–8) grains along forging flow lines in the specimens. |
| 3–4 (75%) | 899 | 9–10[~90%] & 6–7 (~10%] | — | Fine-grained microstructure with occurrences of coarser (ASTM 6–7) grains along forging flow lines in the specimens. |
| 3–3 (75%) | 913 | 9–10(8) [100%] | 4–6 [<<1%] | Fine-grained microstructure with an isolated region containing a few coarse grains (ASTM 4–6) in the shear band region of one specimen. |
| 3–4 (75%) | 913 | 9–10 [>95%] & 5–6(4) [<5%] | — | Predominantly fine-grained microstructure with infrequent occurrences of larger grains. |

TABLE 27-continued

Summary of Austenite Grain Coarsening Data for Steel V6 (High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 927 | 9–10(8) [100%] | — | Uniformly fine-grained microstructure. |
| 3–4 (75%) | 927 | 9–10 [70–85%] & 2–4(1,5) [15–30%] | — | Uniformly duplexed grain structure. |
| 3–3 (75%) | 941 | 9–10 [100%) | 9–10 [85–90%] & 1–4 [10–15%] | Fine-grained microstructure in the central section and severely duplexed in the shear band regions of the specimens. |
| 3–4 (75%) | 941 | 9–10 [70–80%] & 1–4 [20–30%] | — | Uniformly duplexed grain structure. |
| 3–3 (75%) | 954 | 9–10 [100%] | 3–5 | Predominantly fine-grained microstructure. Observation of a band of ASTM 3–5 along a forging flow line in one of three specimens. |
| 3–4 (75%) | 954 | 9–10(11) [100%]/9–10(11) [~90%] & 6–7(5) [~10%] | 9–11 & 1–5 | Predominantly fine grained with isolated regions of abnormal grain coarsening (ASTM 5–7) in the central sections of the specimens. Grain coarsening evident in the shear band regions of the specimens. |

[1]Refer to FIG. 6 for definition of the various processing schedules. All specimens were austenitized at the indicated temperatures for ten hours.

TABLE 28

Summary of Austenite Grain Coarsening Data for Steel N1 (Low-Temperature Processing Schedule)[1]

| Processing Code | Austenite Grain Size (ASTM #) Central Section of Specimen | Shear Band Regions | Comments |
|---|---|---|---|
| 1–2 (15%) | 9–10(8) [100%] | — | Uniformly fine-grained microstructure. |
| 2–3 (15%) | 7–8 [100%] | — | Uniformly fine-grained microstructure. |
| 2–4 (15%) | 9–10(8,11) [100%] | — | Fine-grained microstructure with a broad range of grain size. |
| 3–3 (75%) | 10–11(9,12) [100%] | — | Fine-grained microstructure with a broad range of grain size. |
| 3–4 (75%) | 9–10(8,11) [100%] | — | Fine-grained microstructure with a broad range of grain size. |

[1]Refer to FIG. 6 for definition of the various processing schedules.

TABLE 29

Summary of Austenite Grain Coarsening Data for Steel N1 (High-Temperature Processing Schedule)[1]

| Processing Code | Austenite Grain Size (ASTM #) Central Section of Specimen | Shear Band Regions | Comments |
|---|---|---|---|
| 1–2 (15%) | 9–10(8) [100%] | — | Uniformly fine-grained microstructure. |
| 2–3 (15%) | 8–9(7) [100%] | — | Fine-grained microstructure with a broad range of grain size. |
| 2–4 (15%) | 8–9 [100%] | — | Uniformly fine-grained microstructure. |
| 3–3 (75%) | 10–11(9,12) [100%] | — | Uniformly fine grained microstructure. |
| 3–4 (75%) | 9–10(11) [100%] | 9–10(11) & 2,–3(1,4) | Uniformly fine-grained microstructure in the central section of the specimens with abnormal grain coarsening in the shear band regions of the specimens. |

[1]Refer to FIG. 6 for definition of the various processing schedules.

TABLE 30

Summary of Austenite Grain Coarsening Data for Steel N2 (Low-Temperature Processing Schedule)[1]

| Processing Code | Austenite Grain Size (ASTM #) Central Section of Specimen | Shear Band Regions | Comments |
|---|---|---|---|
| 1–2 (15%) | 8–9 [100%] | — | Uniformly fine-grained microstructure. |
| 2–3 (15%) | 9–10(8) [100%] | — | Uniformly fine-grained microstructure. |
| 2–4 (15%) | 9–10(7,11) [100%] | — | Predominantly fine grained with occurrences of ASTM 7. |

TABLE 30-continued

Summary of Austenite Grain Coarsening Data for Steel N2 (Low-Temperature Processing Schedule)[1]

| Processing | Austenite Grain Size (ASTM #) | | |
|---|---|---|---|
| Code | Central Section of Specimen | Shear Band Regions | Comments |
| 3–3 (75%) | 10–11(9,12) [100%] | — | Fine-grained microstructure with a broad range of grain size. |
| 3–4 (75%) | 10–11(2) [100%] | — | Uniformly fine-grained microstructure. |

[1]Refer to FIG. 6 for definition of the various processing schedules.

TABLE 31

Summary of Austenite Grain Coarsening Data for Steel N2 (High-Temperature Processing Schedule)[1]

| Processing | Austenite Grain Size (ASTM #) | | |
|---|---|---|---|
| Code | Central Section of Specimen | Shear Band Regions | Comments |
| 1–2 (15%) | 9–10 (8,7) [100%] | — | Predominantly fine-grained microstructure with occurrences of ASTM 7–8. |
| 2–3 (15%) | 9–10 (8,11) [100%] | — | Fine-grained microstructure with a broad range of grain size. |
| 2–4 (15%) | 9–10 (8) [100%] | — | Uniformly fine-grained microstructure. |
| 3–3 (75%) | 10–11 (9) [100%] | — | Uniformly fine-grained microstructure. |
| 3–4 (75%) | 11–12 [100%] | — | Uniformly fine-grained microstructure. |

[1]Refer to FIG. 6 for definition of the various processing schedules.

TABLE 32

Summary of Austenite Grain Coarsening Data for Steel N2 (Low-Temperature Processing Schedule/15% Cold Reduction)[1]

| Processing | Austenitizing | Austenite Grain Size (ASTM #) | | |
|---|---|---|---|---|
| Code | Temperature (° C.) | Central Section of Specimen | Shear Band Regions | Comments |
| 1–2 (15%) | 954 | 8–9 [100%] | — | Uniformly fine-grained microstructure. |
| 2–3 (15%) | 954 | 9–10(8) [100%] | — | Uniformly fine-grained microstructure. |
| 2–4 (15%) | 954 | 9–10(7,11) [100%] | — | Predominantly fine grained with occurrences of ASTM 7. |
| 2–3 (15%) | 982 | 9–11(8) [100%] | — | Fine-grained microstructure with relatively frequent occurrences of ASTM 8. |
| 2–4 (15%) | 982 | 9–11(8) [100%] | — | Fine-grained microstructure with relatively frequent occurrences of ASTM 8. |
| 2–3 (15%) | 1010 | 8–9(10) [100%] | — | Fine-grained microstructure. |
| 2–4 (15%) | 1010 | 8–10 [100%] | — | Fine-grained microstructure. |

[1]Refer to FIG. 6 for definition of the various processing schedules. All specimens were austenitized at the indicated temperatures for ten hours.

TABLE 33

Summary of Austenite Grain Coarsening Data for Steel N2 (High-Temperature Processing Schedule/15% Cold Reduction)[1]

| Processing | Austenitizing | Austenite Grain Size (ASTM #) | | |
|---|---|---|---|---|
| Code | Temperature (° C.) | Central Section of Specimen | Shear Band Regions | Comments |
| 1–2 (15%) | 954 | 9–10(8,7) [100%] | — | Fine-grained microstructure with occurrences of ASTM 7–8. |
| 2–3 (15%) | 954 | 9–10(8,11) [100%] | — | Fine-grained microstructure with a broad range of grain size. |
| 2–4 (15%) | 954 | 9–10(8) [100%] | — | Uniformly fine grained microstructure. |
| 2–3 (15%) | 982 | 8–10(7,11) [100%] | — | Predominantly fine-grained microstructure with a broad range of grain size. Isolated occurrences of ASTM 7. |
| 2–4 (15%) | 982 | 9–10(7,8,11) [100%] | — | Predominantly fine-grained microstructure with a broad range of grain size. Relatively frequent occurrences of ASTM 7. |

TABLE 33-continued

Summary of Austenite Grain Coarsening Data for Steel N2 (High-Temperature Processing Schedule/15% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 2–3 (15%) | 1010 | 9–10(7,8,11) [100%] | — | Predominantly fine-grained microstructure with a broad range of grain size. Relatively frequent occurrences of ASTM 7. |
| 2–4 (15%) | 1010 | 8–10(7,11) [100%] | — | Predominantly fine-grained microstructure with a broad range of grain size. Relatively frequent occurrences of ASTM 7. |

[1]Refer to FIG. 6 for definition of the various processing schedules. All specimens were austenitized at the indicated temperatures for ten hours.

TABLE 34

Summary of Austenite Grain Coarsening Data for Steel N2 (Low-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 954 | 10–11(9,12) [100%] | — | Fine-grained microstructure with a broad range of grain size. |
| 3–4 (75%) | 954 | 10–11(12) [100%] | — | Uniformly fine-grained microstructure. |
| 3–3 (75%) | 982 | 9–10(8) [100%] | — | Uniformly fine-grained microstructure. |
| 3–4 (75%) | 982 | 9–11(8,12) [100%] | 3–4(5,6) | Fine-grained microstructure with a broad range of grain size in the central section of the specimens. Abnormal grain coarsening in the shear band regions of the specimens. |
| 3–3 (75%) | 1010 | 9–10(8,11) [100%] | — | Fine-grained microstructure with a broad range of grain size. |
| 3–4 (75%) | 1010 | 9–11(7,8) [100%] | 0–5 | Predominantly fine-grained microstructure with a broad range of grain size in the central section of the specimens. Infrequent occurrences of abnormal grain coarsening in the shear band regions of the specimens. |

[1]Refer to FIG. 6 for definition of the various processing schedules. All specimens were austenitized at the indicated temperatures for ten hours.

TABLE 35

Summary of Austenite Grain Coarsening Data for Steel N2 (High-Temperature Processing Schedule/75% Cold Reduction)[1]

| Processing Code | Austenitizing Temperature (° C.) | Austenite Grain Size (ASTM #) Central Section of Specimen | Shear Band Regions | Comments |
|---|---|---|---|---|
| 3–3 (75%) | 954 | 10–11(9) [100%] | — | Uniformly fine-grained microstructure. |
| 3–4 (75%) | 954 | 11–12 [100%] | — | Uniformly fine-grained microstructure. |
| 3–3 (75%) | 982 | 10–11(9) [100%] | — | Uniformly fine-grained microstructure. |
| 3–4 (75%) | 982 | 10–11(9) [100%] | −2,−1,0,1 | Fine-grained microstructure with a broad range of grain size in the central section of the specimens and abnormal grain coarsening in the shear band regions of the specimens. |
| 3–3 (75%) | 1010 | 9–10(8,11) [100%] | — | Fine-grained microstructure with a broad range of grain size. |
| 3–4 (75%) | 1010 | 10–11(9,12) [100%] | >−2,−1 | Fine-grained microstructure with a broad range of grain size in the central section of the specimens and abnormal grain coarsening in the shear band regions of the schedules. |

[1]Refer to FIG. 6 for definition of the various processing schedules. All specimens were austenitized at the indicated temperatures for ten hours.

TABLE 36

Summary of Austenite Grain Coarsening Data for Steel N3 (High-Temperature Processing Schedule)[1]

| Processing Code | Austenitizing Temperature (° C.) | Austenite Grain Size (ASTM #) Central Section of Specimen | Shear Band Regions | Comments |
|---|---|---|---|---|
| 2–3 (15%) | 954 | 10–11(8,9) [100%] | — | Fine-grained microstructure with isolated occurrences of ASTM 8–9. |
| 2–4 (15%) | 954 | 10–11(8,9) [100%] | — | Fine-grained microstructure with moderately frequent occurrences of ASTM 8–9. |
| 2–3 (15%) | 982 | 10–11(8,9) [100%] | — | Fine-grained microstructure with relatively frequent occurrences of ASTM 8–9. |
| 2–4 (15%) | 982 | 10–11(8,9) [100%] | — | Fine-grained microstructure with relatively frequent occurrences of ASTM 8–9 |
| 2–3 (15%) | 1010 | 10–11(8,9) [100%] | — | Fine-grained microstructure with relatively frequent occurrences of ASTM 8–9. |
| 2–4 (15%) | 1010 | 10–11(8,9) [100%] | — | Fine-grained microstructure with relatively frequent occurrences of ASTM 8–9. |
| 3–3 (75%) | 954 | 10–11(9) [100%] | — | Uniformly fine-grained microstructure. |
| 3–4 (75%) | 954 | 9–10(11,12) [30–95%] & 6–9 [5–20%] | — | Duplexed grain structure. |
| 3–3 (75%) | 982 | 10–11(9) [100%] | — | Uniformly fine-grained microstructure. |
| 3–4 (75%) | 982 | 10–12 [75–95%] & 5–7(4) [5–25%] | — | Duplexed grain structure. |
| 3–3 (75%) | 1010 | 10–11(9) [100%] | 10–11(9) & 0 | Fine-grained microstructure in the central section of the specimens with abnormal grain coarsening in the shear band region of one specimen. |
| 3–4 (75%) | 1010 | 10–11(9) [60–100%] & 3–6(1,2) [0–40%] | — | Severely duplexed grain structure. |

[1]Refer to FIG. 6 for definition of the various processing schedules. All specimens were austenitized at the indicated temperatures for ten hours.

TABLE 37

Summary of Austenite Grain Coarsening Data for Steel A3 - Modified Annealing Treatments (High-Temperature Processing Schedule /75% Cold Reduction)[1]

| Processing Code | Annealing & Austenitizing Temperatures (° C.) | Austenite Grain Size (ASTM #) Central Section of Specimen | Shear Band Regions | Comments |
|---|---|---|---|---|
| 3–3 (75%) | 720 & 913 | 10–11(9) [100] | — | Uniformly fine-grained microstructure. |
| 3–4 (75%) | No Anneal & 913 | 11–12(10) [100%] | 11–12(10) [>98%] & 6–7 [<2%] | Fine-grained microstructure in the central section with a slightly duplexed grain structure in the shear band regions of the specimens. |
| 4–3 (75%) | 500 & 913 | 10–11(8,9) [100%] | 10–11(8,9) [>>99%] & 7 [<<1%] | Fine-grained microstructure in the central section and fine grained with a broad range of grain size in the shear band regions of the specimens. |
| 4–3 (75%) | 500 + 720 & 913 | 9–10(8) [100%] | 9–10(8) [>>99%] & 7 [<<1%] | Fine-grained microstructure in the central section and fine grained with a broad range of grain size in the shear band regions of the specimens. |
| 4–3 (75%) | 550 & 913 | 9–10 [100%] | 9–10 [>>99%] & 7 [<<1%] | Fine-grained microstructure in the central section and fine grained with a broad range of grain size in the shear band regions of the specimens. |
| 4–3 (75%) | 550 + 720 & 913 | 9–10 [100%] | 9–10 [>>99%] & 7 [<<1%] | Fine-grained microstructure in the central section and fine grained with a broad range of grain size in the shear band regions of the specimens. |
| 3–3 (75%) | 720 & 927 | 9–10 [100%] & | — | Uniformly fine-grained microstructure. |
| 3–4 (75%) | No Anneal & 927 | 9–10 [100%] | 9–10 [>98%] & 6–7 [<2%] | Fine-grained microstructure in the central section with a slightly duplexed grain structure in the shear band regions of the specimens. |
| 4–3 (75%) | 500 & 927 | 9–10(8) [100%] | 9–10(8) [>>99%] & 7 [<<1%] | Fine-grained microstructure in the central section and fine grained with a broad range of grain size in the shear band regions of the specimens. |

TABLE 37-continued

Summary of Austenite Grain Coarsening Data for Steel A3 - Modified Annealing Treatments (High-Temperature Processing Schedule /75% Cold Reduction)[1]

| Processing Code | Annealing & Austenitizing Temperatures (° C.) | Austenite Grain Size (ASTM #) Central Section of Specimen | Shear Band Regions | Comments |
|---|---|---|---|---|
| 4–3 (75%) | 500 = 720 & 927 | 9–10(8) [100%] | 9–10(8) [~98%] & 7 [~2%] | Fine-grained microstructure in the central section and fine grained with a broad range of grain size in the shear band regions of the specimens. |
| 4–3 (75%) | 550 & 927 | 9–10(8) [100%] | 9–10(8) [>99%] & 7 [<<1] | Fine-grained microstructure in the central section and fine grained with a broad range of grain size in the shear band regions of the specimens. |
| 4–3 (75%) | 550 = 720 & 927 | 9–10(8) [100%] | 9–10(8) [>95] & 7 [<5%] | Fine-grained microstructure in the central section and fine grained with a broad range of grain size in the shear band regions of the schedules. |
| 3–3 (75%) | 720 & 941 | 9–10 [100%] | — | Uniformly fine-grained microstructure. |
| 3–4 (75%) | No Anneal & 941 | 9–10 [100%] | 9–10 [~95%] & 6–7(4,5) [~5%] | Fine-grained microstructure in the central section and duplexed (i.e., a low density of coarser grains) in the shear band regions of the specimens. |
| 4–3 (75%) | 500 & 941 | 9–10(8) [100%] | 9–10 [~90%] & 5–7 [~10%] | Fine-grained microstructure in the central section and duplexed in the shear band regions of the specimens. |
| 4–3 (75%) | 500 + 720 & 941 | 9–10(8) [100%] | 9–10(8) [>>99%] & 7 [<<1%] | Fine-grained microstructure in the central section and fine grained with a broad range of grain size in the shear band regions of the specimens. |
| 4–3 (75%) | 550 & 941 | 9–10(8) [100%] | 9–10(8) [~90%] & 6–7(5) [~10%] | Fine-grained microstructure in the central section and duplexed in the shear band regions of the specimens. |
| 4–3 (75%) | 550 + 720 & 941 | 9–10(8) [100%] | 9–10(8) [>>99%] & 7 [<<1%] | Fine-grained microstructure in the central section and fine grained with a broad range of grain size in the shear band regions of the specimens. |
| 3–3 (75%) | 720 & 954 | 9–10(11) [100%] | 9–10 & −2,−1 | Fine-grained microstructure in the central section with severe grain coarsening in the shear band regions of the specimens. |
| 3–4 (75%) | No Anneal & 954 | 8–9(7,10) [>95%] & 5–6 [<5%] | — | Uniformly duplexed grain structure. |
| 3–3 (75%) | 500 & 954 | 9–10(8) [100%] | 9–10 (8)[<99%] & 4–6(3) [~10%] | Fine-grained microstructure in the central section and duplexed in the shear band regions of the specimens. |
| 4–3 (75%) | 500 + 720 & 954 | 9–10(8) [100%] | 9–10(8) [>99%] & 7 [<1%] | Fine-grained microstructure in the central section and fine grained with a broad range of grain size in the shear band regions of the specimens. |
| 4–3 (75%) | 550 & 954 | 9–10(8) [100%] | 9–10 [~95%] & 6–7 [~5%] | Fine-grained microstructure in the central section and duplexed in the shear band regions of the specimens. |
| 4–3 (75%) | 550 + 720 & 954 | 9–10(8) [100%] | 9–10(8) [>99%] & 7 [<1%] | Fine-grained microstructure in the central section and fine grained with a broad range of grain size in the shear band regions of the specimens. |
| 4–3 (75%) | 510 + 720 & 968 | 9–10(8) [100%] | 9–10(8) [>99%] & 7 [<1%] | Fine-grained microstructure in the central section and fine grained with a broad range of grain size in the shear band regions of the specimens. |
| 4–3 (75%) | 550 & 968 | 10–11(9) [~90%] & 6–7(5) [0–10%] | — | Uniformly duplexed grain structure. |
| 4–3 (75%) | 550 + 720 & 968 | 9–10(8) [100%] | 9–10(8) [~90%] & >1, 2, 5–6 [~10%] | Fine-grained microstructure in the central section and severely duplexed in the shear band regions of the specimens. |

[1]Refer to FIG. 6 for definition of the various processing schedules. All specimens were austenitized at the indicated temperatures for ten hours.

TABLE 38

Summary of Austenite Grain Coarsening Data for Steel VI - Modified Annealing Treatments (High-Temperature Processing Schedule/75% Cold Reduction)[1]

| Processing Code | Annealing & Austenitizing Temperatures (° C.) | Austenite Grain Size (ASTM #) Central Section of Specimen | Shear Band Regions | Comments |
|---|---|---|---|---|
| 4–3 (75%) | 500 & 899 | 9–10(8) [100%] | 9–10(8) [>99%] & 7 [<1%] | Fine-grained microstructure in the central section and fine grained with a broad range of grain size in the shear band regions of the specimens. |
| 4–3 (75%) | 500 + 720 & 899 | 9–10(8) [100] & | — | Uniformly fine-grained microstructure. |
| 4–3 (75%) | 500 & 913 | 9–10(8) [100%] | 9–10(8) [>99%] & 7 [<1%] | Fine-grained microstructure in the central section and fine grained with a broad range of grain size in the shear band regions of the specimens. |
| 4–3 (75%) | 500 + 720 & 913 | 9–10(8) [>>99%] & 7 [<<1%] | — | Fine-grained microstructure with a broad range of grain size. |
| 4–3 (75%) | 500 & 927 | 10–11(9) [100%] | 10–11(9) [~90%] & 6–7 [~10%] | Fine-grained microstructure in the central section with minor amounts of abnormal grain growth in the shear band regions of the specimens. |
| 4–3 (75%) | 500 + 720 & 927 | 9–10(8) [100%] | — | Uniformly fine-grained microstructure. |
| 4–3 (75%) | 500 & 941 | 9–10 [100%] | 9–10(8) [~98%] & 6–7 [~2%] | Fine-grained microstructure in the central section with minor amounts of abnormal grain growth in the shear band regions of the specimens. |
| 4–3 (75%) | 500 + 720 & 941 | 9–10(8) [>99%] & 7 [<1%] | — | Uniformly fine-grained microstructure with a broad range of grain size in isolated regions. |
| 4–3 (75%) | 500 & 954 | 8–9 [100%] | 8–9 [~99%] & 6–7 [~1%] | Fine-grained microstructure in the central section with minor amounts of abnormal grain growth in the shear band regions of the specimens. |
| 4–3 (75%) | 500 + 720 & 954 | 8–9(7) [100%] | 8–9(7) [~98%] & 2,4 [~2%] | Fine-grained microstructure with a broad range of grain size in the central section and severely duplexed in the shear band regions of the specimens. |

[1]Refer to FIG. 6 for definition of the various processing schedules. All specimens were austenitized at the indicated temperatures for ten hours.

TABLE 39

Summary of Austenite Grain Coarsening Data for Steel V3 - Modified Annealing Treatments (High-Temperature Processing Schedule/75% Cold Reduction)[1]

| Processing Code | Annealing & Austenitizing Temperatures (° C.) | Austenite Grain Size (ASTM #) Central Section of Specimen | Shear Band Regions | Comments |
|---|---|---|---|---|
| 4–3 (75%) | 500 & 899 | 9–10 [90–95%] & 6–7 [5–10%] | 9–10 [85–90%] & 5–7 [10–15%] | Slightly duplexed grain structure in the central section with more extensive grain coarsening in the shear band regions of the specimens. |
| 4–3 (75%) | 500 + 720 & 899 | 9–10(8) [100%] | — | Uniformly fine-grained microstructure. |
| 4–3 (75%) | 500 & 913 | 9–10 [~98%] & 5–7 [~2%] | 9–10 [90–95%] & 5–7 [5–10%] | Uniformly duplexed grain structure. |
| 4–3 (75%) | 500 + 720 & 913 | 9–10(8) [>99%] & 7 [<1%] | — | Fine-grained microstructure with a broad range of grain size. |
| 4–3 (75%) | 500 & 927 | 10–11 [~95%] & 5–7 [~5%] | 10–11[~80%] & 3–4(5,6) [~20%] | Uniformly duplexed grain structure. |
| 4–3 (75%) | 500 + 720 & 927 | 9–11(8) [100%] | 9–11(8) [>>99%] & 7 [<<1%] | Fine-grained microstructure in the central section and fine grained with a broad range of grain size in the shear band regions of the specimens. |
| 4–3 (75%) | 500 & 941 | 9 [85–90%] & 2–5 [10–15%] | — | Uniformly duplexed grain structure. |
| 4–3 (75%) | 500 + 720 & 941 | 9–10(8) [100%] | 9–10(8) [~98%] & 3–4(5) [~2%] | Fine-grained microstructure in the central section with abnormal grain coarsening in the shear band regions of the specimens. |
| 4–3 (75%) | 500 & 954 | 9–10 [80–90%] & 2–4 [10–20%] | 9–10 [20–30%] & 2–5 [70–80%] | Uniformly duplexed grain structure. |

TABLE 39-continued

| Summary of Austenite Grain Coarsening Data for Steel V3 - Modified Annealing Treatments (High-Temperature Processing Schedule/75% Cold Reduction)[1] | | | | |
|---|---|---|---|---|
| Processing | Annealing & Austenitizing | Austenite Grain Size (ASTM #) | | |
| Code | Temperatures (° C.) | Central Section of Specimen | Shear Band Regions | Comments |
| 4–3 (75%) | 500 + 720 & 954 | 9–10(8) [100%] | 9–10 [~50%] & >1, 1, −3 [~50%] | Fine-grained microstructure in the central section and severely duplexed in the shear band regions of the specimens. |

[1]Refer to FIG. 6 for definition of the various processing schedules. All specimens were austenitized at the indicated temperatures for ten hours.

TABLE 40

| Hardness Data for Al-N Steels[1] | | | | | |
|---|---|---|---|---|---|
| | Processing | As-Rolled | As-Annealed | Hardness After Forming and Second Anneal | |
| Steel | Condition[2] | Hardness | Hardness | 15% Reduction | 75% Reduction |
| A1 | LT | HRB 95.7 ± 0.7 | HRB 87.8 ± 0.9 | HRB 82.6 ± 1.9 | HRB 83.2 ± 1.0 |
| | HT | HRB 96.2 ± 0.6 | HRB 85.9 ± 0.3 | HRB 84.7 ± 1.3 | HRB 81.4 ± 0.7 |
| A2 | LT | HRB 92.4 ± 0.7 | HRB 81.2 ± 0.3 | HRB 83.7 ± 1.4 | HRB 76.5 ± 2.0 |
| | HT | HRB 96.7 ± 0.9 | HRB 85.9 ± 0.3 | HRB 88.4 ± 0.4 | — |
| A3 | LT | HRB 94.3 ± 0.4 | HRB 81.6 ± 0.7 | HRB 84.6 ± 0.5 | — |
| | HT | HRB 97.4 ± 0.2 | HRB 85.1 ± 1.1 | HRB 87.0 ± 0.5 | HRB 78.4 ± 1.7 |
| A4 | HT | HRB 96.9 ± 1.2 | HRB 88.5 ± 0.7 | HRB 88.7 ± 1.7 | HRB 83.6 ± 1.6 |

[1]Mean values and standard deviations.
[2]KT = low-temperature processing schedule; HT = high-temperature processing schedule.

TABLE 41

| Hardness Data for Nb-Al-N Steels[1] | | | | | |
|---|---|---|---|---|---|
| | Processing | As-Rolled | As-Annealed | Hardness After Forming and Second Anneal | |
| Steel | Condition[2] | Hardness | Hardness | 15% Reduction | 75% Reduction |
| V1 | LT | HRB 99.3 ± 0.2 | HRB 87.3 ± 2.6 | HRB 90.5 ± 0.5 | HRB 77.7 ± 2.3 |
| | HT | HRC 22.6 ± 0.3 | HRB 90.9 ± 0.2 | HRB 92.1 ± 0.3 | HRB 79.5 ± 1.2 |
| V2 | LT | HRC 21.6 ± 0.3 | HRB 88.6 ± 0.7 | HRB 91.3 ± 0.3 | HRB 79.3 ± 2.3 |
| | HT | HRC 23.8 ± 0.3 | HRB 89.6 ± 1.5 | HRB 92.9 ± 0.3 | HRB 81.9 ± 1.4 |
| V3 | LT | HRC 22.1 ± 0.1 | HRB 90.2 ± 0.7 | HRB 91.8 ± 0.3 | HRB 80.9 ± 1.3 |
| | HT | HRC 23.3 ± 0.2 | HRB 92.6 ± 0.6 | HRB 93.2 ± 0.7 | HRB 81.9 ± 1.4 |
| V4 | LT | HRC 25.0 ± 0.2 | HRB 92.4 ± 0.4 | HRB 92.9 ± 0.4 | HRB 82.7 ± 0.8 |
| | HT | HRC 24.7 ± 0.5 | HRB 93.7 ± 0.6 | HRB 94.2 ± 0.3 | HRB 82.7 ± 1.4 |
| V5 | LT | HRC 23.9 ± 0.3 | HRB 91.8 ± 0.3 | HRB 93.5 ± 0.5 | HRB 82.9 ± 0.9 |
| | HT | HRC 25.5 ± 0.3 | HRB 91.7 ± 1.9 | HRB 94.0 ± 0.4 | HRB 81.2 ± 1.2 |
| V6 | LT | HRC 24.5 ± 0.3 | HRB 91.9 ± 0.3 | HRB 92.6 ± 0.4 | HRB 83.6 ± 1.9 |
| | HT | HRC 24.7 ± 0.4 | HRB 93.5 ± 0.3 | HRB 94.2 ± 0.3 | HRB 83.4 ± 0.5 |

[1]Mean values and standard deviations.
[2]KT = low-temperature processing schedule; HT = high-temperature processing schedule.

TABLE 42

| Hardness Data for Nb-Al-N Steels[1] | | | | | |
|---|---|---|---|---|---|
| | Processing | As-Rolled | As-Annealed | Hardness After Forming and Second Anneal | |
| Steel | Condition[2] | Hardness | Hardness | 15% Reduction | 75% Reduction |
| N1 | LT | HRB 94.1 ± 0.2 | HRB 85.0 ± 0.5 | HRB 87.4 ± 1.3 | HRB 79.0 ± 0.9 |
| | HT | HRC 21.9 ± 0.4 | HRB 92.3 ± 0.9 | HRB 93.1 ± 0.4 | HRB 82.5 ± 1.9 |
| N2 | LT | HRB 94.4 ± 0.9 | HRB 83.9 ± 0.7 | HRB 88.5 ± 0.6 | HRB 80.4 ± 2.0 |
| | HT | HRC 21.8 ± 0.5 | HRB 92.7 ± 0.9 | HRB 92.4 ± 1.0 | HRB 80.9 ± 1.5 |
| N3 | HT | — | HRB 92.9 ± 1.2 | HRB 95.6 ± 0.4 | HRB 87.1 ± 1.6 |

[1]Mean values and standard deviations.
[2]KT = low-temperature processing schedule; HT = high-temperature processing schedule.

TABLE 43

Summary of Cold-Formability Data for Production Steels[1]

| Steel | Sulfur Content (%) | Processing Condition[2] | Annealed Hardness (HRB)[3] | Occurrence of Cracking (%)[4] |
|---|---|---|---|---|
| A1 | 0.019 | LT | 87.8 ± 0.9 | 43 |
| | | HT | 85.9 ± 0.3 | 0 |
| A4 | 0.018 | HTM | 88.5 ± 0.7 | 13 |
| N2 | 0.015 | LT | 83.9 ± 0.7 | 62 |
| | | HT | 92.7 ± 0.9 | 40 |
| N3 | 0.018 | HTM | 92.9 ± 1.2 | 67 |

[1]Data obtained from 12.7 mm ϕ × 25 mm compression specimens subjected to a 75% cold reduction.
[2]LT = low-temperarure processing schedule; HT = high-temperature processing schedule; HTM = high-temperature mill processing schedule.
[3]Mean values and standard deviations.
[4]In all cases, cracking consisted of the formation of small surface cracks or surface bursts on the compression specimens.

What is claimed is:

1. A method of processing high-nitrogen steels for optimizing the austenite grain coarsening resistance of cold-formed components during carburization, comprising the steps of:

(a) providing a steel having a composition including a grain-refining addition, (b) reheating the steel at a temperature in the vicinity of a solution temperature of the least soluble species of grain-refining precipitate in the steel;

(c) hot-working by finish rolling or forging the steel;

(d) cooling the steel at an accelerated rate to 500° C.;

(e) subcritically annealing the steel at a temperature in a range from about 650° C. to the $A_{cl}$ to produce a ferritic microstructure containing dispersed iron/alloy carbides and a dispersion of fine grain-refining precipitates;

(f) subjecting the steel to at least one cold-forming operation with intermediate anneals to form a steel component;

(a) subjecting the steel component to a subcritical anneal at a temperature in a range from about 600° C. to the $A_{cl}$ after the last cold-forming operation to provide a ferritic microstructure containing dispersed iron/alloy carbides; and (h) carburizing, quenching and tempering the steel component.

2. The process of claim 1 wherein the steel composition includes in percent by weight: 0.1–0.3% C, 150–220 ppm N, and 0.026–0.039% Al as the grain-refining addition, wherein:

$$[\%Al] \leqq 1.92[\%N]+1.12[\%O].$$

3. The process of claim 1 wherein the steel composition includes in percent by weight: 0.1–0.3% C and 150–220 ppm N, wherein the grain-refining addition is V and Al in an amount of 0.08–0.15% V and 0.026–0.039% Al.

4. The process of claim 1 as applied to steels consisting essentially of 0.1–0.3% C and 150–220 ppm N, wherein the grain-refining addition is Nb and Al in an amount of 0.02–0.04% Nb and 0.026–0.039% Al, and the Al content is defined as:

$$[\%Al] \leqq 1.92[\%N]-0.045[\%N][\%C]^{-0.56}+1.12[\%O].$$

5. The process of claim 1 where the accelerated cooling step after the hot-working step comprises one or more cooling steps selected from the group consisting of water quenching, oil quenching, water-mist cooling, and forced-air cooling.

6. A method for optimizing the austenite grain coarsening resistance of cold-formed steel components during carburizing, comprising the steps of:

(a) providing a steel consisting essentially of 0.1–0.3% C, 0.02–0.04% Nb, 0.026–0.039% Al and 150–220 ppm N, wherein:

$$[\%Al] \leqq 1.92[\%N]-0.045[\%Nb][\%C]^{-0.56}+1.12[\%O],$$

the balance being substantially iron and other alloying elements found in typical carburizing grades;

(b) reheating the steel at a temperature approximating a solution temperature of a least soluble species of grin-refining precipitate in the steel;

(c) cooling the steel to at least 1100° C.;

(d) hot working by finish rolling or forging the steel at temperatures in the 900–1100° C. range to precipitate Nb(C,N) and an amount of AlN;

(e) cooling the steel with a recrystallized austenite microstructure at an accelerated rate to 500° C.;

(f) subcritically annealing the steel at a temperature in a range from about 650° C. to the $A_{cl}$, to complete the precipitation of AlN and to produce a ferritic microstructure containing dispersed iron/alloy carbides and a dispersion of fine grain-refining precipitates;

(g) subjecting the steel to at least one cold-forming operation with intermediate anneals to form a steel component;

(h) subjecting the steel component to a subcritical anneal at a temperature in a range from about 600° C. to the $A_{cl}$ after the last cold-forming operation to provide a ferritic microstructure containing dispersed iron/alloy carbides and (i) carburizing, quenching and tempering the steel component.

7. The process of claim 6 where the accelerated cooling step after the hot-working step comprises one or more cooling steps selected from the group consisting of water quenching, oil quenching, water-mist cooling, and forced-air cooling.

8. A process for improving austenite grain coarsening resistance of cold-formed, high-nitrogen steel components during carburization, comprising the steps of:

(a) providing a steel having a composition including a rain-refining addition;

(b) reheating at a temperature approximating a solution temperature of a least soluble species of grain-refining precipitate in the steel;

(c) hot working by finish rolling or forging the steel;

(d) cooling the steel at an accelerated rate to 500° C.;

(e) subcritically annealing the steel at a temperature in the range from about 650° C. to the $A_{cl}$ for a sufficient amount of time to produce a ferritic microstructure containing dispersed iron/alloy carbides and a dispersion of fine gain-refining precipitates:

(f) subjecting the steel to at least one cold-forming operation with intermediate anneals to form a steel component;

(g) subjecting the steel component to a recovery annealing steel and (h) carburizing, quenching and tempering the steel component.

9. The process of claim 8 wherein the steel composition includes in percent by weight: 0.1–0.3% C, 150–220 ppm N, and 0.026–0.039% Al as the grain-refining addition, wherein:

$$[\%Al] \leqq 1.92[\%N]+1.12[\%O].$$

10. The process of claim 8 wherein the steel composition includes in percent by weight: 0.1–0.3% C and 150–220 ppm N, wherein the grain-refining addition is V and Al in an amount of 0.08–0.15% V and 0.026–0.039% Al.

11. The process of claim 8 wherein the steel composition includes in percent by weight: 0.1–0.3% C and 150–220 ppm N, wherein the grain-refining addition is Nb and Al in an amount of 0.02–0.04% Nb and 0.026–0.039% Al, and the Al content is defined as:

$$[\%Al] \leqq 1.92[\%N]-0.045[\%Nb][\%C]^{-0.56}+1.12[\%O].$$

12. The process of claim 8 where the accelerated cooling steel after the hot-working step comprises one or more cooling steps selected from the group consisting of water quenching, oil quenching, water-mist cooling, and forced-air cooling.

13. The process of claim 8 wherein the recovery annealing step comprises at least a two-stage recovery anneal at progressively increasing temperatures up to about the $A_{cl}$ to provide a ferritic microstructure with dispersed iron/alloy carbides.

14. The process of claim 8 where the recovery annealing step comprises an isothermal recovery anneal that provides a ferritic microstructure with dispersed iron/alloy carbides.

15. The process of claim 8 where the recovery annealing step comprises a short-time recovery anneal followed by heating at a slow rate to a carburizing temperature.

16. A process for improving the austenite grain coarsening resistance of cold-formed steel components during carburization, comprising the steps of:

(a) providing, a steel having a composition comprising 0.1–0.3% C, 0.02–0.04% Nb, 0.026–0.039% Al and 150–220 ppm N, wherein:

$$[\%Al] \leqq 1.92[\%N]-0.045[\%Nb][\%C]^{-0.56}+1.12[\%O],$$

the balance being substantially iron and other alloying elements found in typical carburizing grades;

(b) reheating at a temperature approximating a solution temperature of a least soluble species of grain-refining precipitate in the steel;

(c) cooling the steel to at least 1100° C.:

(d) hot working by finish rolling or forging the steel at temperatures in a 900–1100° C. range to precipitate Nb(C,N) and an amount of AlN;

(e) cooling the steel having a recrystallized austenite microstructure at an accelerated rate to 500° C.;

(f) subcritically annealing the steel at a temperature in the range from about 650° C. to the $A_{cl}$ to precipitate a further amount of AlN and to produce a ferritic microstructure containing dispersed ironical carbides and a dispersion of fine grain-refining precipitates;

(g) subjecting the steel to at least one cold-forming operation with intermediate anneals to form a steel component;

(h) subjecting the steel component to a recovery annealing step; and (i) carburizing, quenching and tempering the steel component.

17. The process of claim 16 where the accelerated cooling step after the hot-working step comprises one or more cooling steps selected from the group consisting of water quenching, oil quenching, water-mist cooling, and forced-air cooling.

18. The process of claim 16 wherein the recovery annealing step comprises at least a two-stage recovery anneal at progressively increasing temperatures up to about the $A_{cl}$ to provide a ferritic microstructure with dispersed iron/alloy carbides.

19. The process of claim 16 where the recovery annealing step comprises an isothermal recovery anneal that provides a ferritic microstructure with dispersed iron/alloy carbides.

20. The process of claim 16 where the recovery annealing step comprises a short-time recovery anneal followed by heating at a slow rate to a carburizing temperature.

21. A steel composition having resistance to austenite grain coarsening in a cold-formed and carburized condition, consisting essentially of in percent by weight: 0.1–0.3% C, 150–220 ppm N and a grain-refining addition consisting of V plus Al, wherein the V content is 0.08–0.15% and the Al content is 0.026–0.035%, the balance comprising Fe and other alloying elements typically found in carburizing grades of steel.

22. A steel composition having resistance to austenite grain coarsening in a cold-formed and carburized condition, said composition consisting essentially of in percent by weight: 0.1–0.3% C, 0.015–0.22% N, a grain-refining addition consisting of 0.026–0.039% Al, and wherein Al satisfies the inequality: $(\%Al) \leqq 1.92\ (\%N)+1.12\ (\%O)$, the balance comprising iron and other alloying elements typically found in carburizing grades of steel.

* * * * *

UNITED STATES PATENT AND TRADEMARK OFFICE

CERTIFICATE OF CORRECTION

PATENT NO. : 6,312,529 B1
DATED : November 6, 2001
INVENTOR(S) : Michael J. Leap et al.

It is certified that error appears in the above-identified patent and that said Letters Patent is hereby corrected as shown below:

Column 1,
Line 24, “forced automobile parts” should read -- forged automobile parts --.

Column 2,
Line 59, after “0%Al” delete “to”.

Column 3,
Line 49, “grain-reining” should read -- grain-refining --.
Line 64, after “($[Al]_{EFF}$” insert -- / --.

Column 6,
Line 8, “grain-reining” should read -- grain-refining --.

Column 7,
Line 51, “123°” should read -- 1230° --.
Line 62, “rain-refining” should read -- grain-refining --.

Column 8,
Line 12, after “process” delete period and insert comma -- , --.
Line 17, “arnnealing” should read -- annealing --.
Line 25, “austenirization” should read -- austenitization --.
Line 56, “grain strictures” should read -- grain structures --.
Line 64, “poor 2rain” should read -- poor grain --.

Column 9,
Line 21, “Tnus” should read -- Thus --.
Line 54, “rains” should read -- grains --.
Line 54, “(the” should read -- (i.e., the --.
Line 62, “[A]” should read -- [Al] --.

Column 10,
Line 30, after “V2” insert -- ) --.
Line 30, “fine-trained” should read -- fine-grained --.

Column 11,
Line 22, “cold-forced” should read -- cold-forged --.
Line 29, “tile” should read -- the --.
Line 30, “cold-foged” should read -- cold-forged --.
Line 35, “cold-forced” should read -- cold-forged --.

UNITED STATES PATENT AND TRADEMARK OFFICE

CERTIFICATE OF CORRECTION

PATENT NO. : 6,312,529 B1
DATED : November 6, 2001
INVENTOR(S) : Michael J. Leap et al.

It is certified that error appears in the above-identified patent and that said Letters Patent is hereby corrected as shown below:

Column 12,
Line 7, "9541" should read -- 954 --.
Line 40, "rained" should read -- grained --.

Column 13,
Line 5, "rain" should read -- grain --.
Line 6, "anneaiinz" should read -- annealing --.
Line 37, "or 530°" should read -- or 550° --.

Column 14,
Line 35, "carburizing,." should read -- carburizing. -- (delete comma)
Line 49, "Yangiva" should read -- Yangiya --.

Column 16,
Line 5, "fine-rained" should read -- fine-grained --.

Columns 15-16,
Table 1, column "S" in row "N1": "0.011" should read -- 0.014 --.
Table 1, column "V" in row "V5": "0.11" should read -- 0.14 --.
Table 3, second column, row 3: "9-10(3)" should read -- 9-10(8) --.
Table 3, last column, fourth row: "of the structures." should read -- of the specimens. --

Columns 19-20,
Table 9, third column, sixth row: "[5-10]" should read -- [5-10%] --.

Columns 21-22,
Table 10, second column, third row, "[<95%]" should read -- [>95%] --.
Table 11, column 2, row 4: "[100%)]" should read -- [100%] --.

Columns 23-24,
Table 12-continued, column 2, row 1: before "1,0,1" insert hyphen (-).
Table 12-continued, column 2, row 1: "[100%]" should read -- [~80%] --.
Table 14, column 2, row 3: before "2," insert hyphen (-).

Columns 25-26,
Table 17, column 2, row 2 and row 4: "[100]" should read -- [100%] --.

UNITED STATES PATENT AND TRADEMARK OFFICE

CERTIFICATE OF CORRECTION

PATENT NO. : 6,312,529 B1
DATED : November 6, 2001
INVENTOR(S) : Michael J. Leap et al.

It is certified that error appears in the above-identified patent and that said Letters Patent is hereby corrected as shown below:

Columns 27-28,
Table 20, column 2, row 2: "5-10" should read -- 8-10 --.
Table 20, column 2, row 5: "& 9" should read -- /9 --.
Table 20, column 2, row 5: "(0.30%)" should read -- [0 - 30%] --.
Table 20, column 3, row 5: "& 9" should read -- /9 --.
Table 20, column 3, row 5: "(95-100%)" should read -- [95-100%] --.

Columns 29-30,
Table 22, column 3, row 6: "[~85%)" should read -- [~85%] --.

Columns 31-32,
Table 24, last column, row 5: "and regions" should read -- band regions --.
Table 24, column 3, row 11: "(~90%]" should read -- [~90%] --.
Table 25, column 3, row 8: "(85-90%]" should read -- [85-90%] --.

Columns 33-34,
Table 26, column 4, row 1: "2-3" should read -- 2-3(1) --.
Table 27, column 3, row 2: "(~10%]" should read -- [~10%] --.

Columns 35-36,
Table 27-continued, column 3, row 3: "[100%)" should read -- [100%] --.

Columns 37-38,
Table 30-continued, column 2, row 2: "(2)" should read -- (12) --.

Columns 39-40,
Table 35, column 5, last row: "of the schedules." should read -- of the specimens. --

Columns 41-42,
Table 36, in the heading: after "High-Temperature" insert -- Mill --.
Table 36, column 3, line 8: "[30-95%]" should read -- [80-95%] --.
Table 37, column 3, row 1 "[100]" should read -- [100%] --.

Columns 43-44,
Table 37-continued, column 1, row 10, delete "the specimens."
Table 37-continued, last column, row 9, after "regions of" insert -- the specimens. --

UNITED STATES PATENT AND TRADEMARK OFFICE

CERTIFICATE OF CORRECTION

PATENT NO. : 6,312,529 B1
DATED : November 6, 2001
INVENTOR(S) : Michael J. Leap et al.

It is certified that error appears in the above-identified patent and that said Letters Patent is hereby corrected as shown below:

Columns 43-44,
Table 37-continued, column 2, row 1: "500 = 720" should read -- 500 + 720 --.
Table 37-continued, column 2, row 3: "550 = 720" should read -- 550 + 720 --.
Table 37-continued, column 3, next-to-last row: "[~90%]" should read -- [90-100%] --.
Table 37-continued, column 4, row 2: "[<<1]" should read --[<1]--.
Table 37-continued, column 4, row 12: "9-10(8)[<99%] &" should read -- 9-10 [~90%] % --.

Columns 45-46,
Table 38, column 3, row 2: "[100]" should read -- [100%] --.
Table 39, column 4, row 4: delete "range of grain size."
Table 39, column 5, row 4: after "with a broad" insert -- range of grain size. --

Column 47,
Table 40, footnote 2: "KT" should read -- LT --.
Table 41, footnote 2: "KT" should read -- LT --.
Table 42, footnote 2: "KT" should read -- LT --.

Column 49,
Line 26, "addition," should read -- addition; --.
Line 39, paragraph "(a)" should read paragraph -- (g) --.
Line 61, "0.045[%N]" should read -- 0.045[%Nb] --.

Column 50,
Lines 12-13, "grin-refining" should read -- grain-refining --.
Line 33, "carbides and" should read -- carbides; and --.
Line 45, in paragraph (a): "rain-refining" should read -- grain-refining --.
Line 56, paragraph (e): "precipitates:" should read -- precipitates; --.
Line 61, paragraph (g): "steel" should read -- step --.

Column 51,
Line 15, "steel" should read -- step --.
Line 33, paragraph (a): "providing, a" should read -- providing a --.
Line 44, paragraph (c): after "1100º C" delete colon and insert semicolon (;).

UNITED STATES PATENT AND TRADEMARK OFFICE

CERTIFICATE OF CORRECTION

PATENT NO. :6,312,529 B1 
DATED : November 6, 2001
INVENTOR(S) : Michael J. Leap et al.

It is certified that error appears in the above-identified patent and that said Letters Patent is hereby corrected as shown below:

Column 52,
Line 6, paragraph (f): "ironical" should read -- iron/alloy --.

Signed and Sealed this

Twenty-fourth Day of September, 2002

*Attest:*

*Attesting Officer*

JAMES E. ROGAN
*Director of the United States Patent and Trademark Office*